US008621883B2

(12) United States Patent
Burk et al.

(10) Patent No.: US 8,621,883 B2
(45) Date of Patent: Jan. 7, 2014

(54) ROTATING VALVE AND HEAT PUMP

(75) Inventors: Roland Burk, Suttgart (DE); Thomas Haller, Waldburg (DE)

(73) Assignee: Behr GmbH & Co. KG, Stuttgart (DE)

( * ) Notice: Subject to any disclaimer, the term of this patent is extended or adjusted under 35 U.S.C. 154(b) by 715 days.

(21) Appl. No.: 12/861,493

(22) Filed: Aug. 23, 2010

(65) Prior Publication Data

US 2011/0030408 A1 Feb. 10, 2011

Related U.S. Application Data

(63) Continuation of application No. PCT/EP2008/010383, filed on Dec. 8, 2008.

(30) Foreign Application Priority Data

Feb. 22, 2008 (DE) ..... 10 2008 010 662
Oct. 28, 2008 (DE) ..... 10 2008 053 555

(51) Int. Cl.
*F25B 13/00* (2006.01)

(52) U.S. Cl.
USPC ..... 62/324.6; 62/515

(58) Field of Classification Search
USPC ..... 62/324.6, 216, 515; 165/96, 163, 166; 251/304
See application file for complete search history.

(56) References Cited

U.S. PATENT DOCUMENTS 2,143,565 A * 1/1939 Minea ..... 137/600
4,932,467 A * 6/1990 Wigmore et al. ..... 165/96
6,715,695 B2 * 4/2004 Lorraine ..... 239/102.2
6,811,096 B2 * 11/2004 Frazier et al. ..... 239/398
6,945,236 B2 * 9/2005 Nakai et al. ..... 123/568.12
7,000,638 B2 * 2/2006 Tseng et al. ..... 137/819
7,249,575 B2 * 7/2007 Pottie et al. ..... 123/41.1
7,290,680 B2 * 11/2007 Henry et al. ..... 222/129.1

FOREIGN PATENT DOCUMENTS

DE 198 18 807 A1 10/1999
JP 11 118286 A 4/1999
WO WO 2007/068481 A 2/2007

* cited by examiner

*Primary Examiner* — Mohammad M Ali
(74) *Attorney, Agent, or Firm* — Muncy, Geissler, Olds & Lowe, PLLC

(57) ABSTRACT

A rotating valve is provided that includes an inlet region having a plurality of stationary separate inlets for several flows of a fluid and an outlet region having an in particular identical plurality of stationary separate outlets for the flows of the fluid, wherein between the inlet region and the outlet region a switching region having a switching member that can be rotated about an axis is provided, wherein in a first position of the switching member the plurality of inlets are connected to the plurality of outlets in a first association, and wherein in a second position of the switching member the plurality of inlets are connected to the plurality of outlets in a second association, wherein the switching member comprises a plurality of openings through which the fluid flows flow axially in the direction of the rotation axis and which are moved together with the switching member, the openings alternately covering a plurality of stationary, axially directed openings in the course of the rotation of the switching member, wherein the different associations of the inlets with the outlets are carried out by the alternating covering of the axially directed openings.

44 Claims, 21 Drawing Sheets

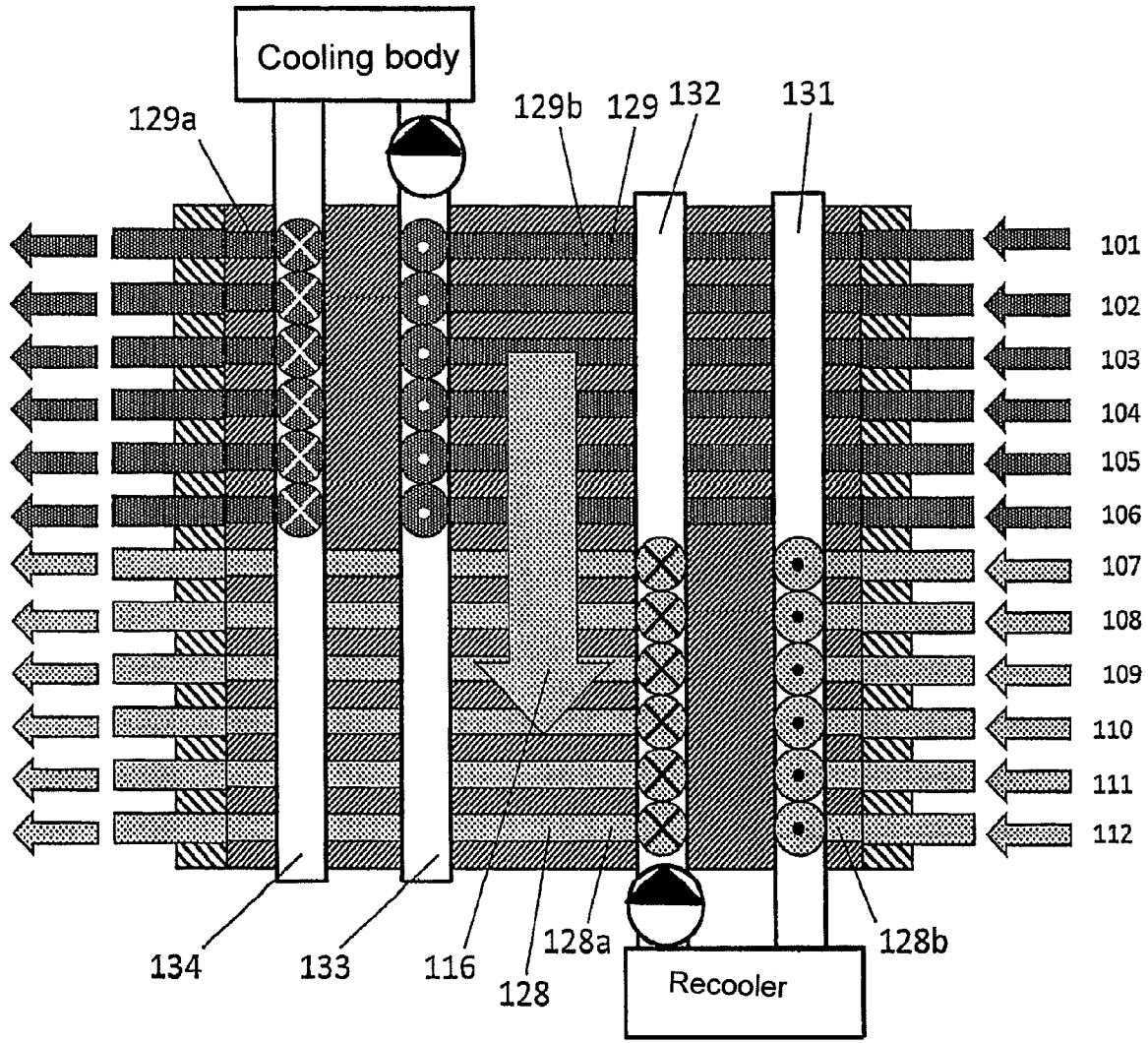
ig. 31

ROTATING VALVE AND HEAT PUMP

This nonprovisional application is a continuation of International Application No. PCT/EP2008/010383, which was filed on Dec. 8, 2008, and which claims priority to German Patent Application No. DE102008010662.3, which was filed in Germany on Feb. 22, 2008, and to German Patent Application No. DE102008053555.9, which was filed in Germany on Oct. 28, 2008 and which are both herein incorporated by reference.

BACKGROUND OF THE INVENTION

1. Field of the Invention

The invention relates to a rotating valve as well as to a heat pump.

2. Description of the Background Art

For the alternating connection of a plurality of fluid flows for controlling a heat pump with a large number of respectively thermodynamically active flow channels fundamentally the use of rotating valves is known.

WO 2007/068481 A1, which corresponds to U.S. Publication No. 20090000327, and which is incorporated herein by reference, describes a heat pump of a stack of plate-like hollow elements fixedly connected to one another, wherein the hollow elements comprise adsorber/desorber regions and one hollow element respectively represents one flow channel. The plurality of flow channels are alternately connected to one another in series via pairs of rotating valves arranged at the end side of the hollow elements in order to achieve an optimization of the power of the heat pump with given size.

A heat pump of this type as defined by the invention has many possible uses, e.g., waste heat recovery in steady-state technology, e.g., building engineering, solar air conditioning or also stationary air-conditioning systems for vehicles, in particular commercial vehicles.

SUMMARY OF THE INVENTION

It is therefore an object of the invention to further improve a rotating valve and a heat pump in terms of size, construction cost and efficiency.

This object is attained according to an embodiment of the invention for a rotating valve, whereby through the realization of a switching device of the rotating valve with axially directed openings, an effective and particularly compact solution is provided for alternating connections of the fluid flows. From the conventional art referenced at the outset only radially directed flow openings in the region of the alternating connection are known, which, at least with respect to the installation space, leads to expensive solutions, e.g., double-walled cylinders with openings arranged therein in a radially directed manner and offset with respect to one another.

A rotating valve according to the invention is suitable not only for controlling a plurality of fluid flows of different temperatures for a heat pump, for example, for the recovery of heat, but also in general for the alternating connection of fluid flows, e.g., also for the recovery of the components of a solution, e.g. with chemical reactors.

The switching device can be embodied as an axial longitudinal body, which is accommodated in a fixed, essentially cylindrical wall, wherein either the inlets or the outlets are connected via radially directed openings of the wall. In particular for the connection of a stack of parallel flow channels, a suitable arrangement of the inlets or outlets can be achieved hereby in particular in an evenly spaced straight line.

The longitudinal body can have a number of axially directed separate channels for the fluid flows corresponding to the plurality of inlets, wherein each channel has a radial opening for connecting to one of the openings of the wall. The axially separate channels can be produced, e.g., by axially longitudinally directed bores. In particular the channels can run straight and parallel, so that a coiling of the channels known in the prior art can be omitted.

Particularly advantageously it is provided to avoid the mixing of adjacent fluid flows that at least one of the two, longitudinal body or wall, has full perimeter annular sealing members, which interact in a sealing manner with the respective other of the two, longitudinal body or wall, so that the axially offset openings of the wall are separated from one another. Preferably, in the interest of a simple production, an annular seal can be accommodated on radial projections of at least one of the two, longitudinal body or wall. Alternatively or additionally, the seal can also be embodied in one piece with the longitudinal body and/or the wall. With a suitable choice of material for the longitudinal body and wall, the material of the corresponding component can additionally have a sealing effect, for example, with a suitable choice of material pairings of plastics or plastic and metal. A one-piece embodiment of seals on the respective component can also be provided in the sense that the seals of a different material from the component are sprayed thereon.

In a first advantageous embodiment of the invention, the longitudinal body can be formed as an essentially one-piece component. This can be, e.g., an injection molded part of a plastic, which in particular is reworked through one or more reworking steps, e.g., by inserting bores for longitudinally directed channels.

In an alternative embodiment, the longitudinal body can also be embodied as a plurality of longitudinal body elements stacked in the axial direction. This type of division into several longitudinal body elements renders possible a modular construction, which can be adapted to different numbers of flow channels in the sense of a component sharing concept in a simple manner. Preferably, at least some of the longitudinal body elements are thereby embodied as shared components.

In a further embodiment, the switching device can be penetrated in the axial direction by a rotatable shaft, wherein the shaft in preferred detail embodiment is embodied as a tie rod to hold several components of the switching device arranged axially one behind the other. The switching device can hereby be dismantled easily for purposes of maintenance or the replacement of worn parts.

In an embodiment, the switching device can be rotatably supported on the end side via a bearing member, wherein the bearing member has a rotation seal to seal the fluid. In general, a precise guidance of the switching device with the reduction of frictional forces is hereby rendered possible, wherein the rotation seal represents an additional barrier to fluid leaks, which in particular is useful with fluids harmful to health or the environment. Expediently, respectively one bearing member can be provided on opposite ends of the switching device.

A rotating valve according to the invention is particularly suitable for switching a large number of inlets and outlets, so that in a preferred embodiment respectively at least four, in particular at least eight, inlets and outlets are available.

The object of the invention is also attained for a rotating valve. With this solution according to the invention of a rotating valve, through the provision of a separate seal in the end-side regions of the division walls and the sealing support thereof a particularly good sealing of the separate channels of the switching device is achieved, whereby the effectiveness and operational safety of the rotating valve is clearly improved with respect to the prior art with simple means.

The seal can have in particular a U-shaped, H-shaped or X-shaped cross section. Other suitable cross sections are also conceivable. In an embodiment, the seal can be embodied with an elastic sealing tab, which bears against the inner wall. Generally advantageously, the seal is thereby inserted positively into a groove of the division wall, whereby measures such as adhesion or other complex attachments can be omitted.

Generally advantageously, in an embodiment of this type the channels for changing the position are alternately covering openings, offset in the circumferential direction and radially directed, of the inner wall of a fixed inner cylinder, wherein annular chambers separate from one another, arranged one behind the other in the axial direction are provided between the inner cylinder and an outer housing surrounding it. With this design, the connection is achieved by alternating overlapping of radially directed openings. A desired separation of the openings and channels in the course of the sweeping over can be achieved hereby in particular by a suitable design of the width of the seal in the circumferential direction. With sufficiently wide design of the seal, a connection of adjacent flow channels at any time of the circulation of the rotating switching device can thereby be prevented, wherein the average opening times for all of the flow channels are correspondingly reduced. Alternatively, a narrower seal in the circumferential direction can also be provided, wherein to avoid an unfavorable connection of adjacent flow channels, the rotating switching device is rotated in step-like switching movements that are sufficiently quick to avoid a mixture of the fluid flows.

The object of the invention is furthermore attained for a rotating valve. In this embodiment according to the invention, through the concentric annular grooves a compact, reliable and cost-effective connection of inlet channels to rotating switching channels of the switching device is achieved. This type of structural solution is expedient in particular for rotating valves with only relatively few, e.g. two to four, flow channels. Fundamentally, however, it can also be used for embodiments with more flow channels. In this solution it is also expedient that the channels for changing the position overlap with radially directed openings, offset in the circumferential direction, of the inner wall of a fixed inner cylinder, wherein annular chambers separated from one another and arranged one behind the other in the axial direction are provided between the inner cylinder and an outer housing surrounding it.

The object of the invention is attained for a heat pump. The combination of a rotating valve according to the invention with a heat pump is particularly advantageous, since through the optimization of the rotating valve with respect to tightness or size, the properties of the heat pump with respect to size or output are improved.

The object of the invention is furthermore attained for a heat pump. Through the embodiment of the hollow elements as a respective stack of several parallel layers of sub-elements, a particularly good heat conduction between the fluid flowing around and the thermodynamically active regions of the hollow elements is guaranteed. The output of the heat pump with given installation space can be increased hereby.

The first fluid in exchange with the first zone and the second fluid in exchange with the second zone are different from one another and have no connection in the circulations. Depending on the requirements, for the purposes of the invention they can also be fluids that are identical in material which can also have a connection with one another, depending on the embodiment.

In an embodiment of the heat pump, the hollow elements are embodied as adsorber elements, which have an adsorption/desorption region for the working fluid in the region of the first zone and in the region of the second zone have a condensation/evaporation region for the working fluid. Depending on the field of application of the heat pump, the working fluid and adsorption/desorption means can be selected to be different.

In a detailed arrangement, at least one of the flow channels has end-side connection pieces, wherein the fluid is distributed in the region of the connection pieces among a plurality of flow paths. In an expedient detail arrangement, in a simple manner one or more flow paths for the fluid can be embodied by one or more gaps between sub-elements arranged on top of one another. In an arrangement, the gaps can be with surface enlarging.

In an embodiment, the hollow elements can be respectively embodied as separate modules, which in particular are not in thermal contact with one another. In this manner an undesirable exchange of thermal energy between adjacent flow paths is reduced. This is important in particular for those adjacent flow paths that have a high temperature difference from one another due to the current connection. In a preferred further development, a layer of a thermally insulating, in particular elastic material can thereby be arranged between adjacent hollow elements. For example, this can be a foamed plastic or a fibrous blanket insulator.

In one possible embodiment of the invention, the valve arrangement can be embodied as a connection of a number of discrete multiway valves, in particular, which can be actuated electromagnetically. In particular in the case of heat pumps with a relatively small number of flow paths, a connection of this type of discrete valves can be expedient, wherein rotating valves according to the invention are advantageous in particular with an increasing number of flow paths.

In an embodiment, the valve arrangement comprises at least one, in particular at least two, rotating valves, since the fluid flows can be switched cost-effectively and reliably by the rotating valves according to the invention.

In an embodiment, at least some of the flow channels of the hollow elements are connected via elastically deformable connecting pieces to the inlets and/or outlets of the rotating valve. Expansions of the heat pump caused thermally can hereby be compensated in a simple manner, which is useful in particular with large stacks of hollow elements.

In an embodiment of the invention, the second fluid can be composed of air. Air can hereby be guided for the purpose of conditioning, such as, for example, heating or cooling, directly via the hollow elements in particular of the second zone. Depending on the design and mode of operation of the heat pump, the air flow can thereby the used to heat or cool, for example, a building or a vehicle. However, for the purposes of the invention the air can also be regarded quite generally as a heat transporting medium, without it being used as a conditioning ambient air, e.g., for people or technical equipment.

In an embodiment according to the invention, the rotating valve of the second fluid can have a switching device with a division wall coiled in steps, wherein in particular a number of steps of the coiling corresponds to a number of hollow elements. A switching device of this type can hereby be combined with an only single-walled surrounding cylinder, without a continuous coiling of the division walls, which is relatively expensive to produce, having to be provided. A construction of this type is desirable in particular for gaseous fluids such as air with high volume flows and at the same time small pressure differences, since measures such as, for example, annular chambers of double-walled outer cylinders could be an interference here. In the interest of a particularly simple production, the switching device is thereby embodied from a plurality of switching device elements in particular embodied as shared components arranged axially one behind the other.

In a further embodiment of the invention, the second fluid can be distributed via a rotating valve with two flow channels over the two zones (B) of the hollow elements. A distribution of this type over only two channels is advantageous in particular for gaseous fluids of relatively low thermal capacity such as air, since large flow cross sections and thus large volume flows can thereby be realized with a small pressure difference.

Another embodiment of the rotating valve can have at least one inlet of the plurality of inlets connected to an associated outlet in a first heat exchanger allocation, in particular via a first heat exchanger, such as a heater. The heat exchanger is preferably a heat source that is arranged outside the rotating valve. At least one further inlet of the plurality of inlets is connected to an associated outlet in a second heat exchanger allocation, in particular via a second heat exchanger, such as a cooler. The second heat exchanger is preferably a heat sink, which is likewise arranged outside the rotating valve. The other inlets of the plurality of inlets are connected to associated outlets in a passage allocation, in particular via respective one through channel, with associated outlets. The rotating valve described above can replace two rotating valves controlled in phase, such as are described above. The number of seals required can be clearly reduced thereby. Furthermore, the friction moments occurring during the operation of the rotating valve can be reduced. The rotating valve described above requires less installation space than the rotating valves described therebefore, which, assembled in pairs, fulfill the same function as a single rotating valve described above. The material used to produce a rotating valve of this type is likewise reduced. Furthermore, long internal parallel fluid paths, which lead to undesirable pressure losses, as well as inner heat transfers can be reduced. Furthermore, a synchronous operation in phase of several rotating valves, which requires a high expenditure in terms of control engineering, can be omitted. The rotating valve according to the invention makes it possible in a simple manner to connect associated inlets and outlets directly to one another in a stepwise manner or via one of the two heat exchangers. The production costs of the rotating valve can be reduced substantially thereby. Furthermore, a more compact flat arrangement of the overall apparatus is rendered possible.

Another exemplary embodiment of the rotating valve is characterized in that the switching device has a rotating member with a plurality of through channels, which connect the other inlets in the through allocation with the associated outlets. The rotating valve described renders possible in a simple manner the control of a closed fluid circulation through a plurality of thermally active modules either via one of the heat exchangers, in particular a heat source and a heat sink, or via one of the through channels in the manner of a bypass past the heat exchangers. The location of the interconnection of the heat exchangers between respectively two thermally active modules can be shifted in a stepwise manner by a movement of the rotating member.

Another exemplary embodiment of the rotating valve is characterized in that the through channels extend in the axial direction through the rotating member. The through channels extend preferably in a straight line through the rotating member.

Another exemplary embodiment of the rotating valve is characterized in that several, in particular four, annular chambers extend around the rotating member, which chambers are connected to respectively one of the inlets and/or one of the outlets depending on the position of the rotating member. The annular chambers are limited on the radial inside by the rotating member and on the radial outside by a housing of the rotating valve. In the axial direction, the annular chambers are preferably delimited by radial limiting walls which extend from the rotating member radially outwards.

Another embodiment of the rotating valve is characterized in that respectively two of the annular chambers are connected to one another in pairs via one of the heat exchangers. The associated fluid channel runs from one of the inlets via one of the annular chambers to one of the heat exchangers. From the heat exchanger the fluid channel then runs via the associated next annular chamber to the associated outlet.

Another embodiment of the rotating valve is characterized in that the annular chambers are connected in pairs to one of the inlets or one of the outlets via radial openings and a connecting channel uninterrupted in the axial direction. The connecting channels are interrupted in that they connect an associated inlet via one of the heat exchangers to the associated outlet. In comparison, the through channels represent bypasses, which render possible a fluid flow past the heat exchangers, that is, directly between an inlet and the associated outlet.

A further exemplary embodiment of the rotating valve is characterized in that the rotating member is embodied and rotatable in a stepwise manner in a stationary housing such that the inlets are successively connected to the associated outlets via various through channels or the annular chambers and one of the heat exchangers. It is thereby rendered possible in a simple manner for two inlets to always be connected via respectively one of the heat exchangers to the associated outlet. The other inlets are directly connected to the associated outlets via the through channels.

Another exemplary embodiment of the rotating valve is characterized in that the housing has essentially the form of a hollow circular cylinder. The jacket of the hollow circular cylinder is preferably interrupted only by connecting channels that connect the annular chambers to the associated heat exchangers. The inlets and outlets preferably extend through the otherwise closed front walls of the housing.

Another exemplary embodiment of the rotating valve is characterized in that the rotating member comprises a plurality of longitudinal body elements stacked in the axial direction. The longitudinal body elements can be stacked, for example, on a drive shaft, which extends through the rotating valve. The longitudinal body elements can be connected to one another by adhesive force, for example, by welding or adhesion. However, it is also possible to brace the longitudinal body elements with one another.

Another exemplary embodiment of the rotating valve is characterized in that at least some of the longitudinal body elements are embodied as shared components. The production and/or installability of the rotating valve are simplified thereby.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 31 is a view of a modified embodiment of the rotating valve from FIG. 26 in a first position.

DETAILED DESCRIPTION

Figure 1:
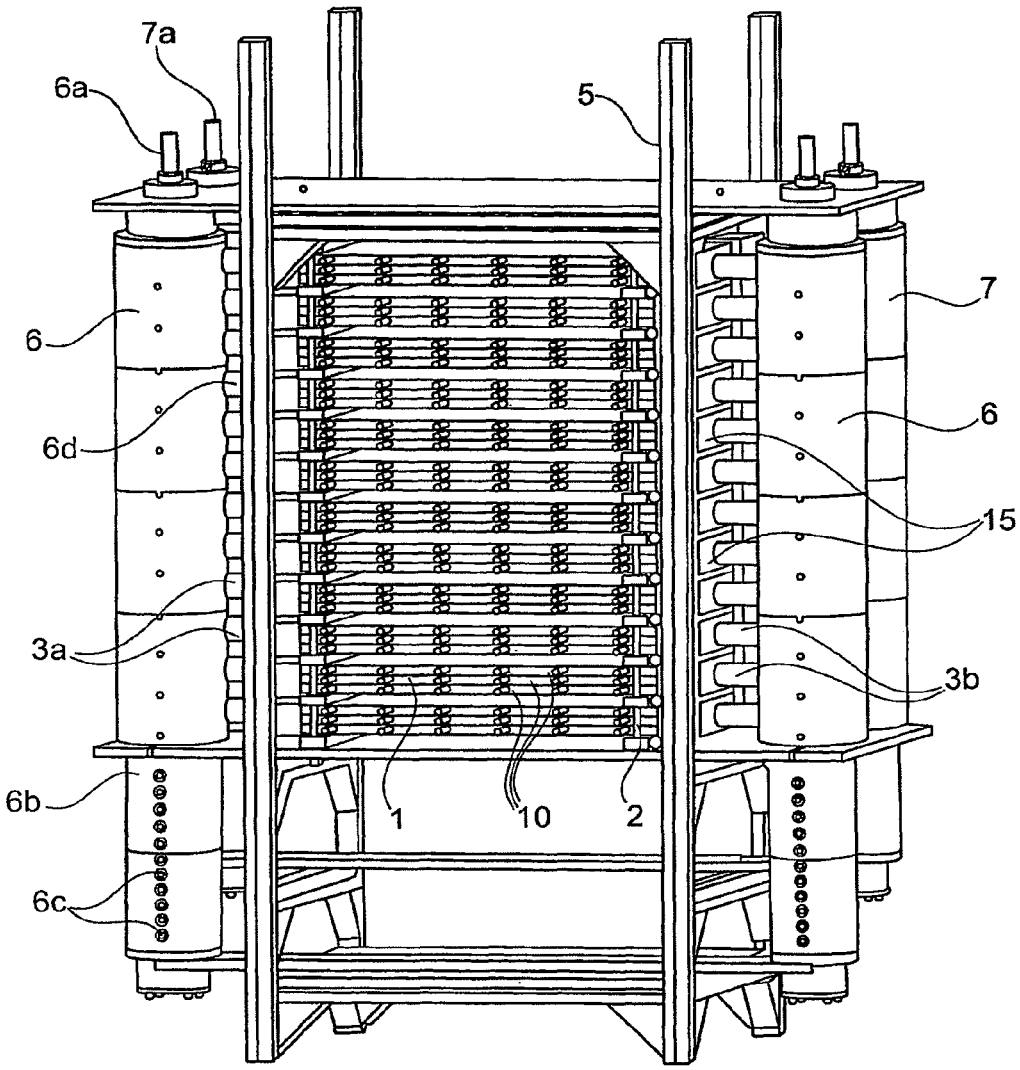
FIG. 1 shows a three-dimensional overall view of a heat pump according to the invention.

FIG. 1 shows a heat pump in which a plurality of, in this case, a total of twelve hollow elements 1 are arranged parallel to one another in the manner of a stack. The stack of hollow elements 1 is connected in a detachable manner to a structural unit via a tie rod 2.

Each of the hollow elements 1 has a first zone A in the form of an adsorption/desorption zone and a second zone B in the form of an evaporation/condensation zone. The first zone A for each of the hollow elements 1 is penetrated by a respectively first flow channel 3 of a first fluid flowing around, conveyed by a pump (not shown), and the second zone B is penetrated for each of the hollow elements 1 by a second flow channel 4 of a second fluid, which is different from the first fluid in the present example, but does not need to be so. Each of the flow channels 3, 4 has thereby front face connections 3*a*, 3*b*, which lie opposite to one another and respectively serve as inlets or outlets from the fluid flowing through the flow channels 3, 4.

The stack of hollow elements 1 held together by the tie rod 2 is arranged in a support frame 5 of the heat pump. On the outside of the support frame 5 a total of four rotating valves are arranged and connected to the stack of hollow elements 1, wherein two essentially identically constructed rotating valves 6 are connected to the inlets and outlets 3*a*, 3*b* of the sorption side A. Two of these rotating valves 7 designed in general differently in particular with respect to the number of flow channels separated in the valve but identical to one another in terms of structure are connected to the second zone or the evaporation/condensation side B of the hollow elements 1.

Figure 2:
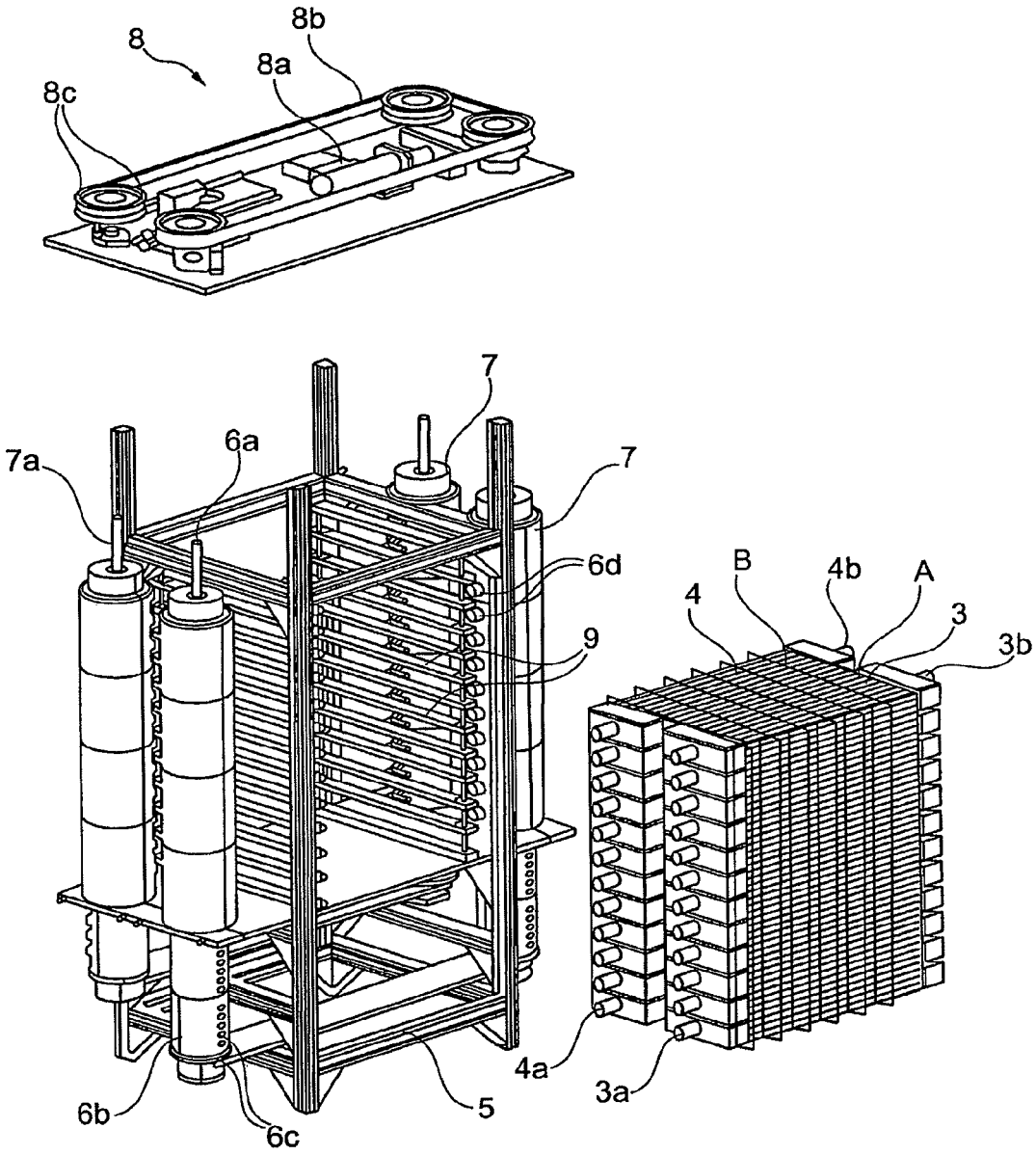
FIG. 2 shows an exploded view of the heat pump from FIG. 1.

The rotating valves 6, 7 are all aligned parallel to one another, wherein central rotary shafts 6*a*, 7*a* of the rotating valves 6, 7 are connected to a modular drive unit 8, which is shown diagrammatically in FIG. 2. The drive unit 8 comprises an electric motor 8*a*, through which four drive wheels 8*c* for driving the respective axes 7*a*, 6*a* of the rotating valves 6, 7 are moved in a synchronized manner via a cam belt 8*b*. In the present construction, all of the rotating valves 6, 7 are driven with, the same angular velocity.

The rotating valves 6 of the sorption side A of the hollow elements 1 have an inlet region 6*b*, which has twelve separate inlets 6*c*, so that each of the twelve hollow elements 1 corresponds to a separate channel inside the rotating valve 6. The rotating valves 7 of the evaporator side B have a smaller number of only four separate inlets 7*c* in an inlet region 7*b*, since on this side of the heat pump such a strongly differentiated separation of the flow channels is not necessary as on the sorption side as a rule. Accordingly, respectively several of the hollow elements 1 are simultaneously connected with respect to their second zone B to respectively one of the flow channels in the valves 7. To this end, we refer to the explanations in the prior art WO 2007/068481.

The adjacent hollow elements 1 are held spaced apart from one another, which in this case is achieved through suitable spacer pieces 9 between the hollow elements. Respectively one air gap thus remains between the hollow elements 1 so that they are thermally well insulated from one another. For the further improvement of the thermal insulation, batts 43 (see FIG. 6) e.g., of foamed polymer or fibrous insulating materials can be inserted.

The individual connections 3*a*, 3*b*, 4*a*, 4*b* of the hollow elements 1 are connected to corresponding connections 6*d*, 7*d* of the rotating valves 6, 7, which extend respectively aligned in a row radially from the walls of a removal region of the essentially cylindrically shaped rotating valves. To compensate for expansions of the heat pump caused thermally, the connections 7*d*, 6*d* of the rotating valves 6, 7 are connected to the connections 3*a*, 3*b*, 4*a*, 4*b* of the stack of hollow elements 1 via elastic connecting pieces, e.g., hose pieces or corrugated bellows.

Figure 4:
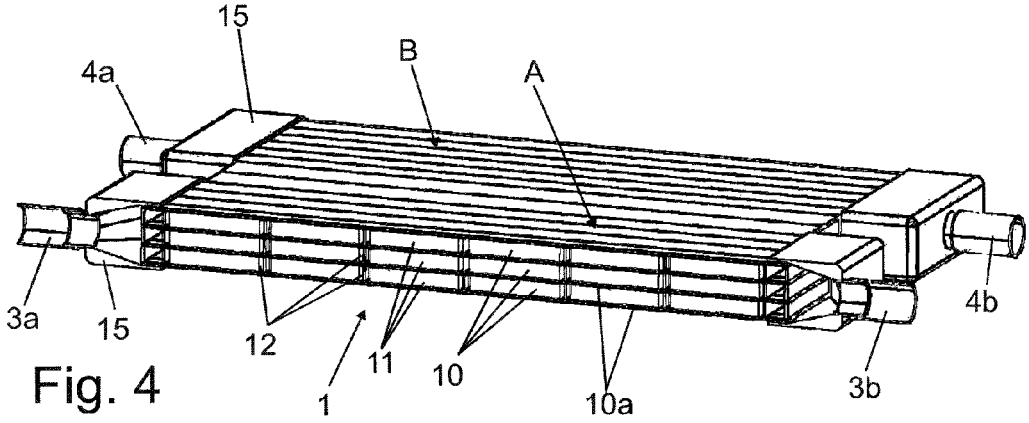
FIG. 4 shows a three-dimensional sectional view of a hollow element of the heat pump from FIG. 1.
Figure 5:
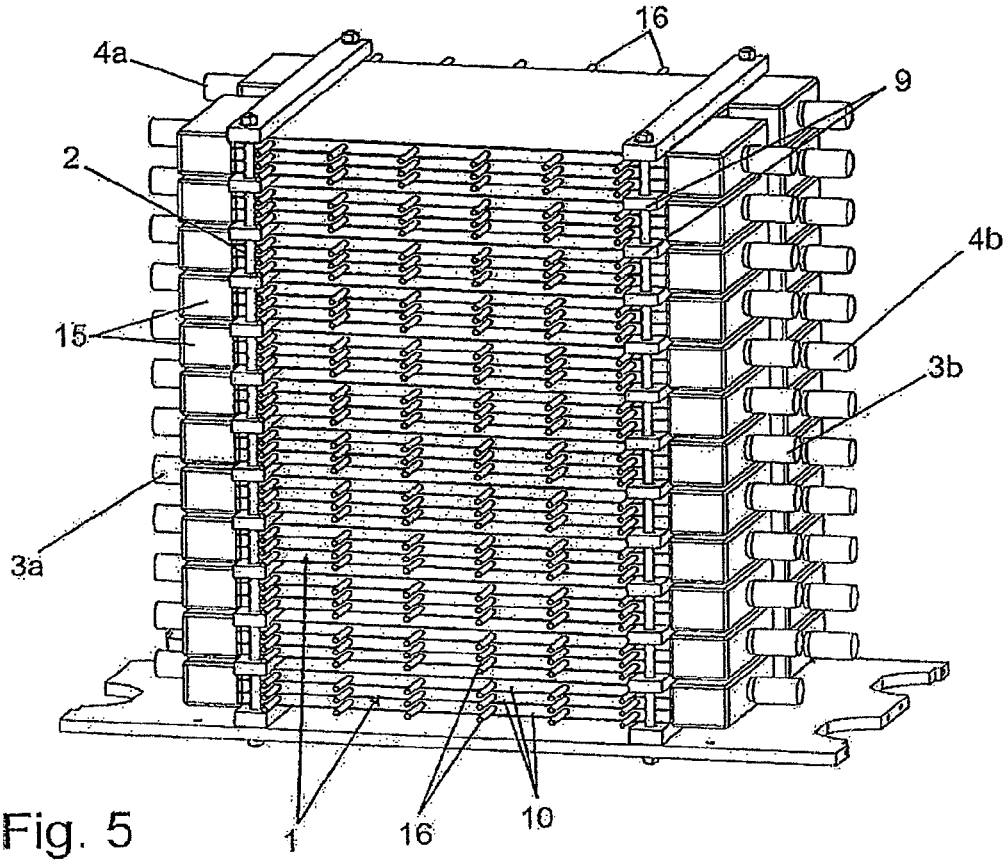
FIG. 5 shows a three-dimensional view of a stack of hollow elements of the heat pump from FIG. 1.
Figure 6:
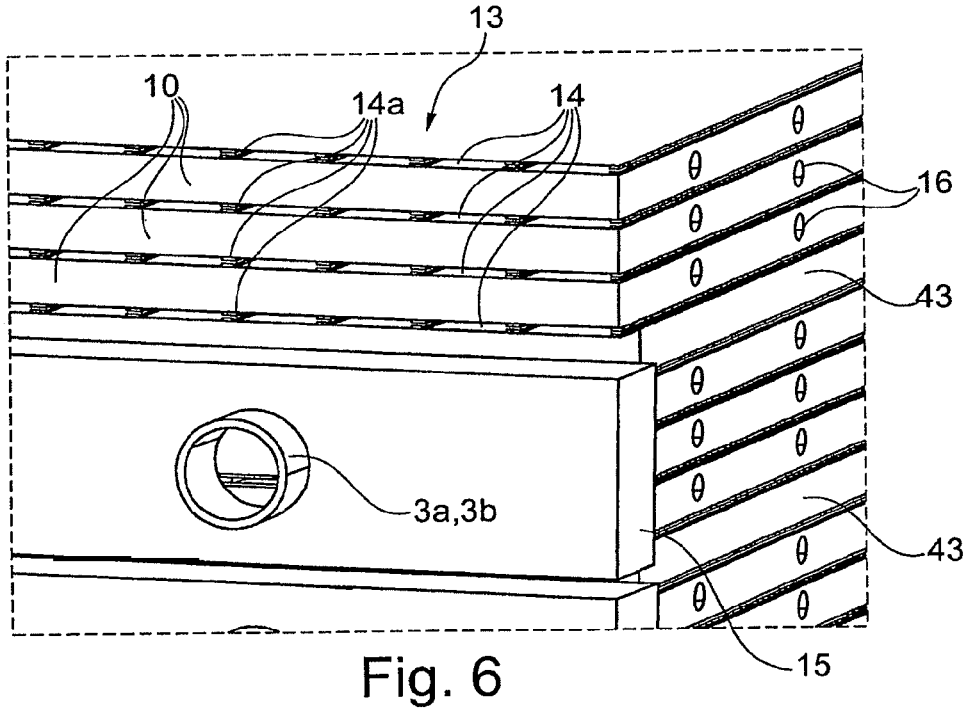
FIG. 6 shows a sectional enlargement of a diagrammatic, partially sectional three-dimensional view of the stack from FIG. 5.

As can be seen in particular from FIG. 4 through FIG. 6, the individual hollow elements 1 to optimize the heat exchange with the fluid are respectively embodied as a stack of sub-elements 10, which are respectively flowed around by the fluid. Each of the sub-elements 10 is embodied as a plate-like flat element, in which several adsorber elements 11 are arranged next to one another in the flow direction of the fluid and are separated from one another in a substance-tight manner via webs 12 perpendicular with respect to the fluid flow direction. The adsorber elements 11 are arranged predominantly in the region of the first zone A (see representation according to FIG. 4), wherein evaporation/condensation structures likewise separated from one another by the webs 12 are arranged in zone B. These structures (not shown) can be composed, e.g., of capillary structures, which can hold a sufficient quantity of a working fluid in the liquid phase. The adsorber elements 11 are composed in the current exemplary embodiment of activated carbon, wherein the working fluid is methanol. Depending on the temperature range and target use of the heat pump, any combinations of adsorption material, working fluid and embodiment of the evaporator region are conceivable. In principle, a heat pump according to the invention is not limited to the adsorption/desorption principle either, any suitable thermodynamically active hollow elements 1 can be provided, for example hollow elements acting in a chemisorptive manner.

Each of the sub-elements 10 is formed as a plate element closed in substance-tight manner by means of cover plates 10*a*. These closed elements 10 are stacked via small spacer pieces 14*a* (see FIG. 6) spaced apart from one another and held spaced apart from outer closing plates 13 of the hollow elements. In each of the hollow elements 1, which in this case are stacked of respectively three sub-elements 10, are thus located four flat flow through paths 14 for the fluid. These flow through paths 14 are further divided by spacer pieces 14*a* extending continuously in the fluid flow direction. In order to further reduce the components, the spacer pieces 14*a* can also be embossings in the cover plates 10*a* and/or closing plates 13.

Furthermore, the flow through paths 14 can be equipped with area-enlarging structures (not shown) such as, for example, ribs.

In the end-side connecting regions of the hollow elements 1 for the fluid, connecting pieces 15 are provided, which distribute the fluid in the manner of a supplying accumulator or scoop among the several flow through regions 14 between the sub-elements 10.

Respectively one filler tube 16 (see FIG. 5) projects laterally from each of the chambers of the sub-elements 10 hermetically separated by the cover plates 10*a* and the webs 12, via which filler tube the individual chambers can be evacuated and filled with working fluid. After the filling, the filler tubes 16 are permanently closed, e.g., by squeezing. In order to simplify the filling operation, a filler tube 16 is arranged on each of the opposite front sides of a respectively hermetically separated chamber, so that the chambers can be flowed through by the working fluid in their longitudinal direction, i.e., perpendicular to the flow direction of the fluid. In the course of the filling operation, on one side a vacuum can thus be applied and on the opposite side the working medium can be fed via the corresponding filler tube.

Overall through this modular structure of the heat pump from separate hollow elements 1 with sub-elements 10, not only is the thermal efficiency improved by thermal insulation of the separate hollow elements, but a construction that is easy to maintain is also created in which only one defective hollow element and not the entire stack of hollow elements needs to be replaced.

Figure 3:
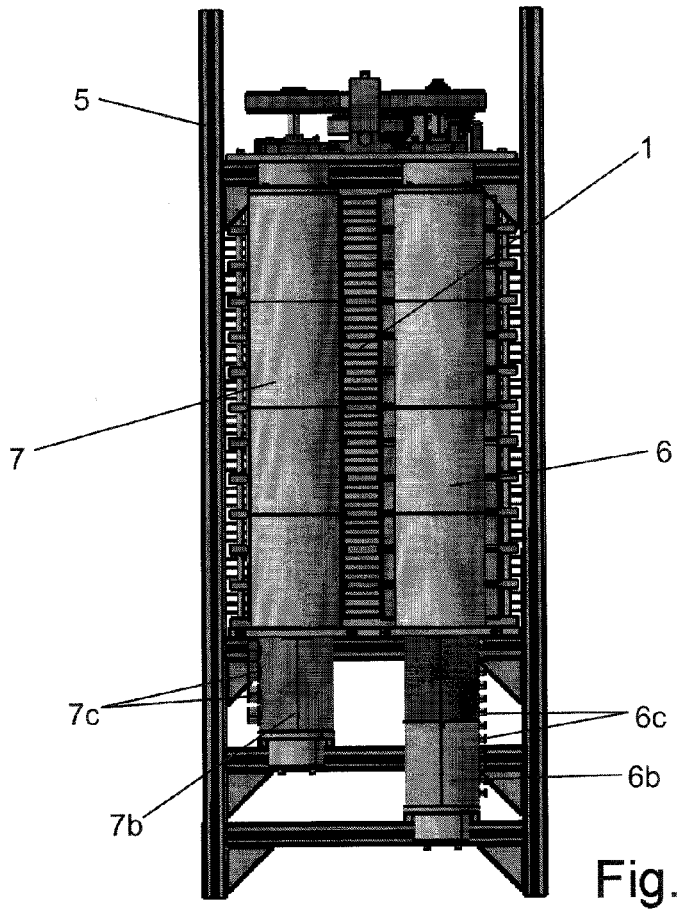
FIG. 3 shows a plan view of the heat pump from FIG. 1 from the side.

The rotating valves 6, 7 shown diagrammatically in the views of the heat pump according to FIG. 1 through FIG. 3 correspond in their structure to the prior art in that the alternating connection of the various flow channels is carried out via radially directed division walls in connection with annular chambers adjoining thereto in double-walled cylinders The division walls form in connection with the openings of the cylinder walls a switching region of the rotating valve.

Figure 7:
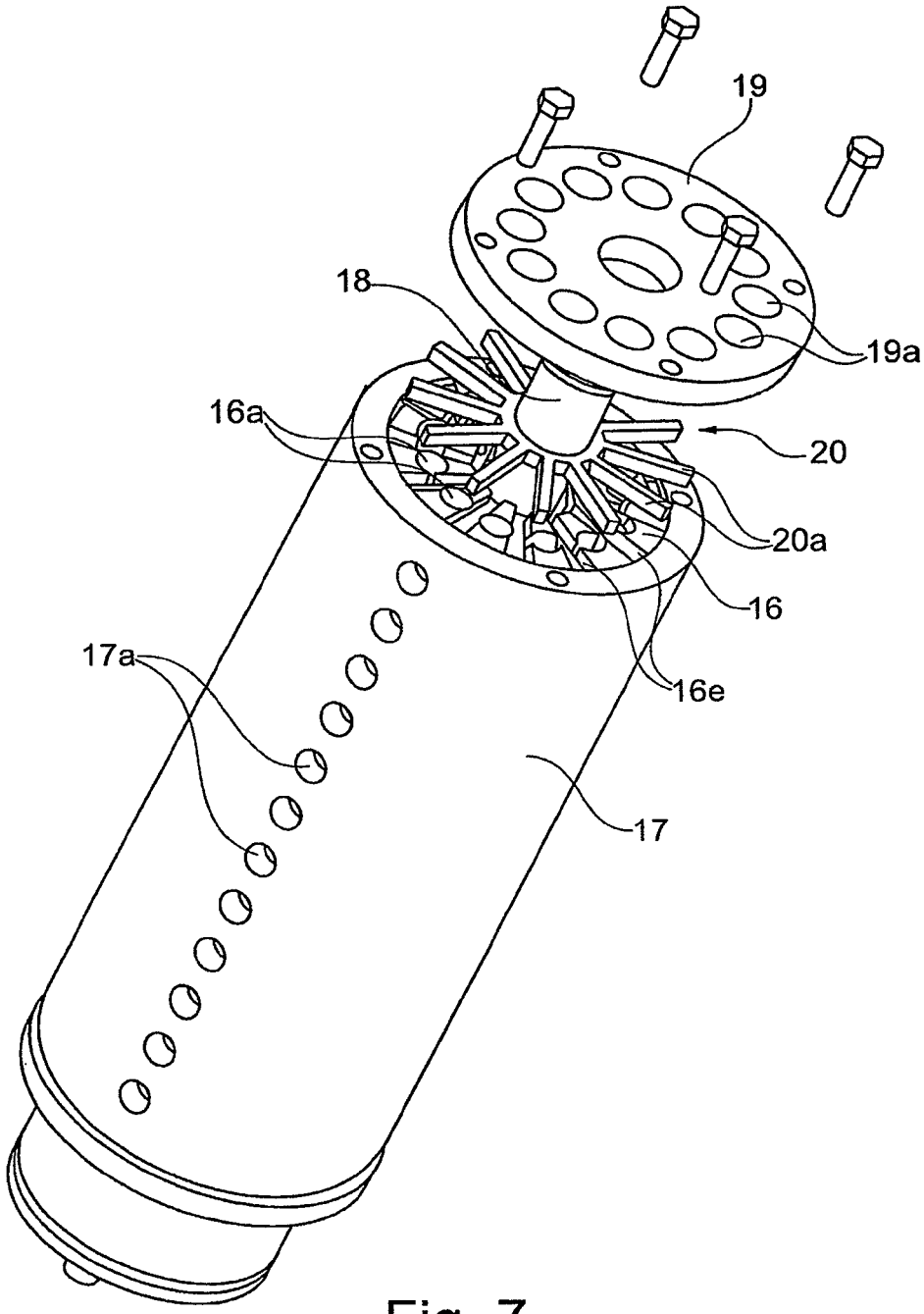
FIG. 7 shows a three-dimensional exploded view of a first exemplary embodiment of a rotating valve according to the invention.

FIG. 7 shows a further development according to the invention of a rotating valve of this type which in a particularly preferred embodiment can be directly combined with the heat pump described above and which has advantages, among other things, with respect to a smaller installation size a simpler producibility and a better sealing of the separate channels.

A rotatably driven switching device 16 is thereby arranged in an only single-walled hollow cylinder 17, which has the equidistant connecting openings 17*a* arranged in a straight row to connect to the connections 3*a*, 3*b* of the stack of hollow elements 1. The switching device 16 is shown separately in FIG. 8. This is an element embodied as an essentially cylindrical longitudinal body, which can be rotated about a central shaft or axis 18. The switching device 16 has in its circumferential direction a number of axial, parallel bores 16*a*, the number of which in this case is twelve and corresponds to the number of hollow elements or separate flow channels connected alternately. A row of in this case annular, peripheral radial projections 16*b* are provided over the length of the switching device 16 embodied as a cylindrical longitudinal body. The projections 16*b* are embodied in pairs, so that between a pair of projections a ring seal (not shown) is held in a positive manner. Overall sealing members to embody equidistant annular chambers 16*c* are hereby formed, which are separated from one anther in a fluid-tight manner by the sealing rings. Each of the annular chambers 16*c* has a bore 16*d* directed radially with respect to the fluid flow, which bore opens in respectively exactly one of the axial channels 16*a*. The radial bores 16*d* are accordingly arranged offset to one another in the circumferential direction so that they form a continuous spiral with the pitch 1. In all, thus each of the front axially opening channel bores 16*a* is radially connected to precisely one annular chamber 16*c*. Each of the annular chambers 16*c* is thereby aligned in a fluid-tight manner sealed against the other annular chambers with one of the connecting openings 17*a* to the stack of hollow elements 1.

As FIG. 7 shows, the front axial openings of the channels 16*a* sweep over corresponding axially directed opening bores 19*a* of a control disk 19, which is placed on the rotating valve, closing the front face, and is connected in a stationary and sealing manner to the outer cylinder 17.

In the course of a rotation of the switching device 16, the individual axial channels 16*a* are thus aligned in the manner of axial openings moved therewith alternately with the various stationary, axially directed inlet openings 19*a* of the control disk 19. In this embodiment the control disk 19 forms an inlet region as defined by the invention and at the same time is a part of the switching region of the rotating valve.

In order to reduce or completely avoid an undesirable fluid exchange of adjacent channels in the region of this switching transition of the openings 19*a* to the openings 16*a*, a star-shaped sealing element 20 is inserted between the control disk 19 and the front face of the switching device 16. The star-shaped fingers 20*a* of the sealing element 20 thereby engage in radial grooves 16*a* of the front face of the switching device 16.

A system of connecting hoses (not shown) is connected to the inlet openings 19*a* of the control disk 19 and leads on the other side according to the basic concept of the heat pump to other openings 19*a* or also to an outer heat exchanger. To connect to outer heat exchanger or heat sources in general we refer to the prior art WO 2007/068481 A1.

Figure 8:
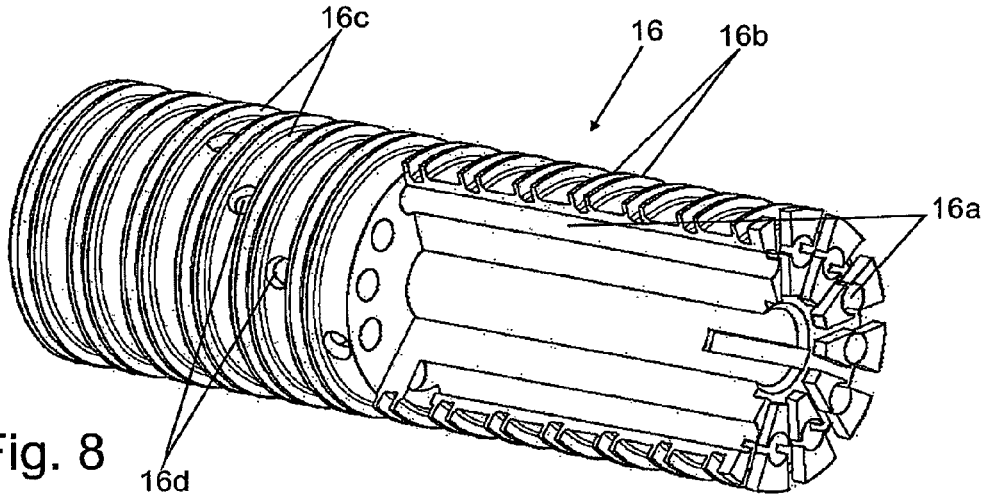
FIG. 8 shows a rotating switching device of the rotating valve from FIG. 7 in a three-dimensional, partially sectional view.
Figure 9:
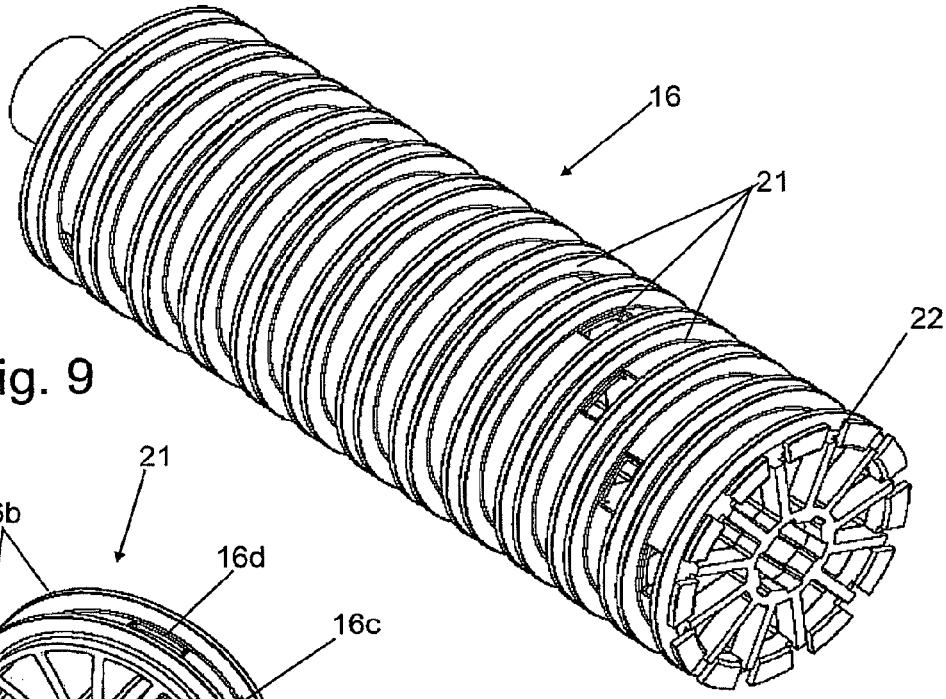
FIG. 9 shows a modification of the switching device embodied in a multipart manner from FIG. 8.
Figure 10:
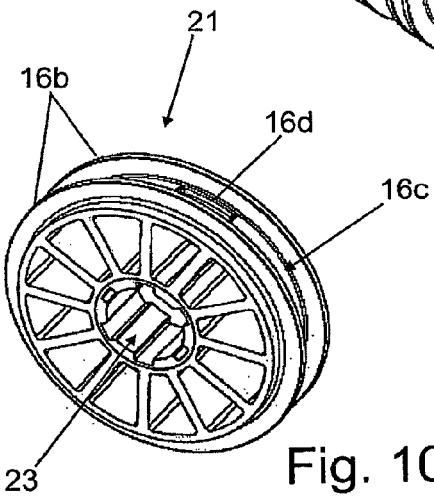
FIG. 10 shows a longitudinal body element of the switching device embodied as a longitudinal body from FIG. 9.

FIG. 9 shows a modification of the switching device 16 identical in terms of function to FIG. 8. The switching device 16 is thereby embodied as a stack of longitudinal body elements 21 (see FIG. 10) as well as an end piece 22 embodied in a different manner. At least some of the longitudinal body elements 21 are thereby identical in structure and placed rotated to one another by a fractional angle according to the number of channels. For the further simplification of a structure of this type, a positive receptacle 23 in the longitudinal body elements 21 is provided for the positive connection to a central drive shaft, wherein the receptacles 23 has a symmetry corresponding to the number of channels. In this case, the receptacle 23 has a rotational symmetry divided only six-fold, so that two longitudinal body elements 21 that are different with respect to the positioning of the radial opening 16*d* relative to the receptacle 23 are used alternately to compose the entire stack of twelve longitudinal body elements.

One variant is not shown in which the shaft and receptacle have a symmetry divided 12-fold, wherein only one type of longitudinal element is then required.

In the present case the rotating valves 6, 7 are produced from a sufficiently temperature-resistant plastic, wherein the stack of hollow elements 1 is essentially composed of metal sheets with respect to its walls and connections. In particular the use of postreticulated thermoplastics is recommended as a plastic for the structure of the rotating valves 6, 7.

Through the construction described above of the switching device 16, a change of the connection of the flow channels by overlapping with respect to the fluid flow of axially directed openings is achieved, whereby the construction length is substantially reduced and the number and shaping of the components are reduced or simplified. In particular, a double-walled cylinder with annular chambers embodied between the fixed cylinder walls in the region of the connections with the stack of hollow elements 1, as in the prior art, can be omitted.

FIG. 11 through FIG. 18 show embodiments and modifications of a rotating valve with a switching device 24 with radial division walls. The channels separated by the division walls 25 extending radially are thereby moved via an inner cylinder with bores 26 offset in the circumferential direction (see FIG. 16) so that the channels in the course of the movement of the division walls 25 respectively overlap successively with various openings 26. Each of the bores 26 thereby opens into an annular chamber 29 embodied between the stationary inner cylinder 27 and a stationary outer cylinder 28. In the outer cylinder 28, connections 30 arranged equidistantly are thereby provided in a straight row to connect to the stack of hollow elements 1. The switching operation for the alternating connecting of the flow channels is carried out in an embodiment of this type by the division walls 25 sweeping over the openings 26 embodied in a radial manner with respect to the fluid flow.

For an embodiment of this type of a rotating valve, a number of improvements according to the invention compared to the prior art are explained below.

Figure 11:
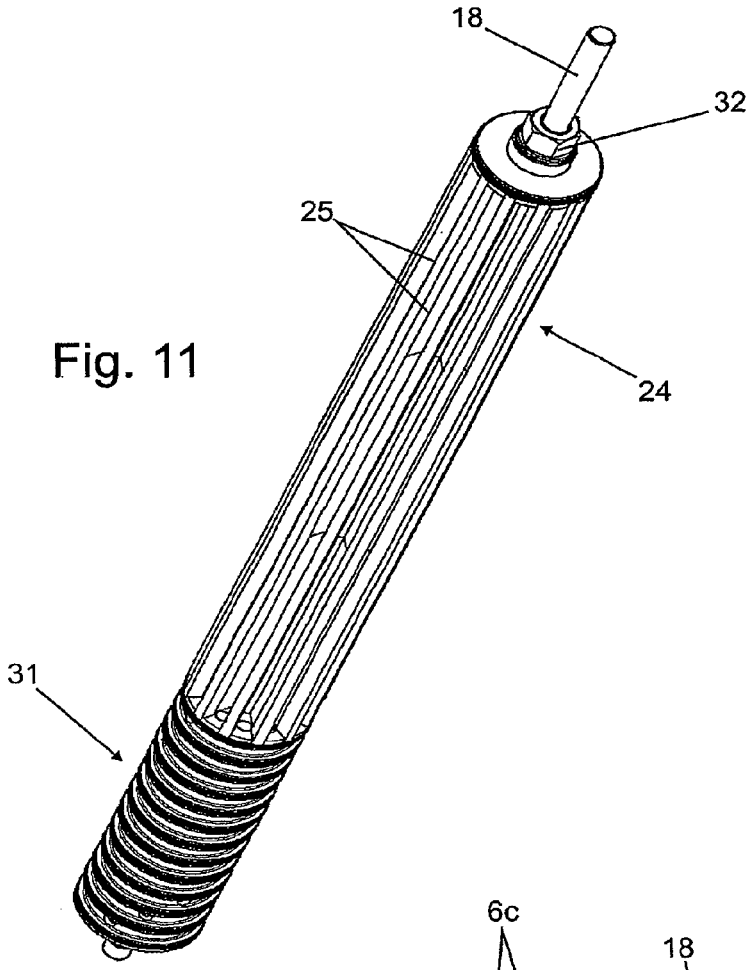
FIG. 11 shows a three-dimensional view of a switching device of a further embodiment of a rotating valve.

FIG. 11 thereby shows an arrangement of the switching device 24 of a rotating valve of this type together with an inlet region 31, which in its design is formed in a similar manner to the switching device 16 from FIG. 8, but here does not take over the function of a switching device, since no change of the positions of the flow channels takes place in the inlet region. The inlet region 31 and the switching device 24 are connected to one another as separate components rotationally fixed via a shaft 18 penetrating them both in the manner of a tie rod by means of a self-locking bolt 32.

Figure 13:
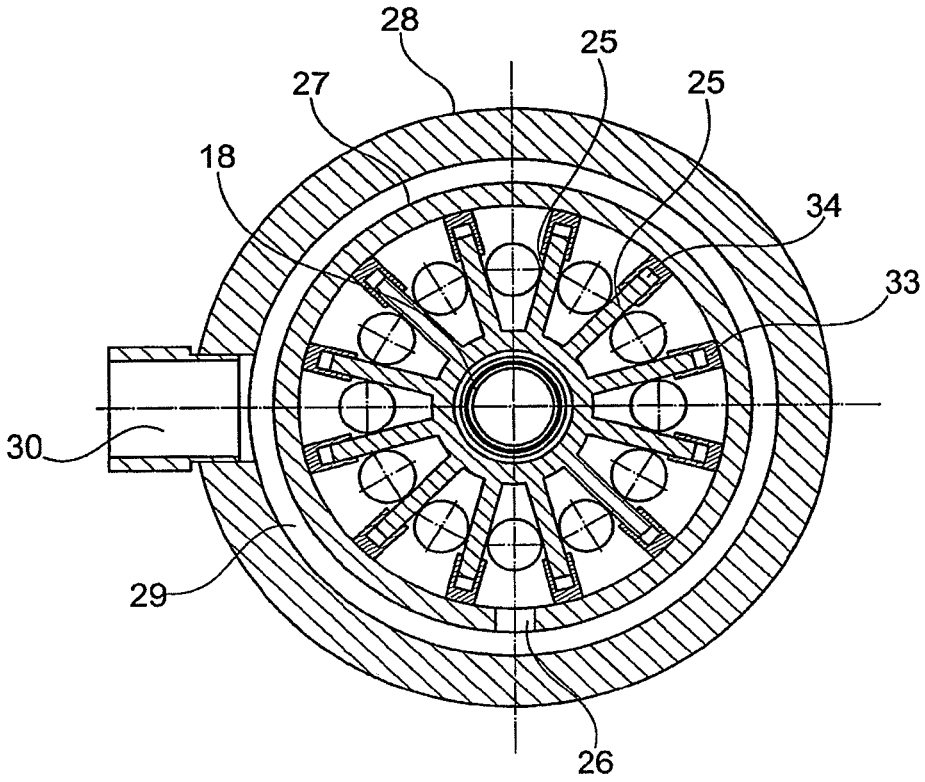
FIG. 13 shows a sectional view through the rotating valve from FIG. 12 perpendicular to a rotation axis of the switching device.

The division walls 25 extending radially in a star-shaped manner have in their radial end regions advantageously elastically arranged sealing means 33 in the manner of axially extending sealing strips. FIG. 13 shows an exemplary embodiment in which the sealing strips 33 have a U-shaped cross section, wherein an additional elastic element 34 is inserted between the front face of the division wall 25 and the sealing means 33. A particularly good seal of the individual axial channels with respect to one another is hereby achieved.

Figure 14:
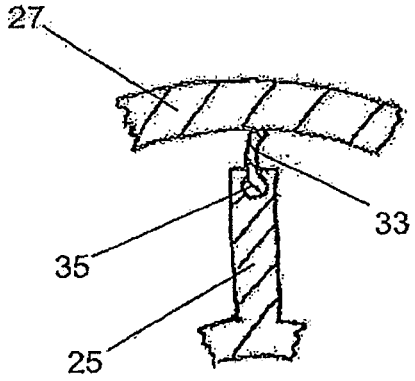
FIG. 14 shows a partial sectional view of a modification of the rotating valve from FIG. 13.
Figure 15:
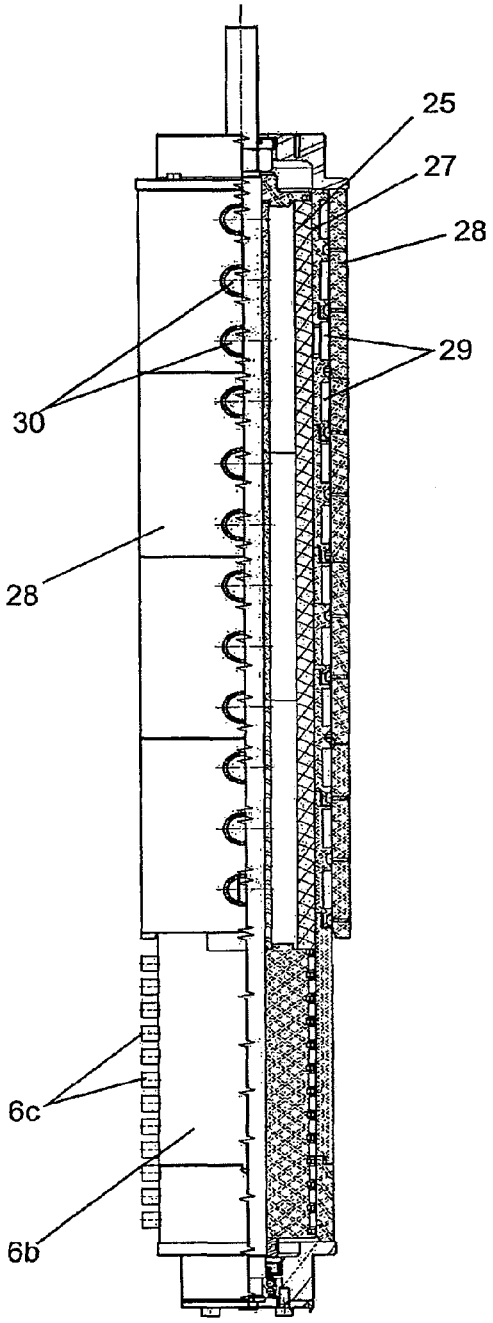
FIG. 15 shows a partial sectional overall view of the rotating valve from FIG. 12.
Figure 16:
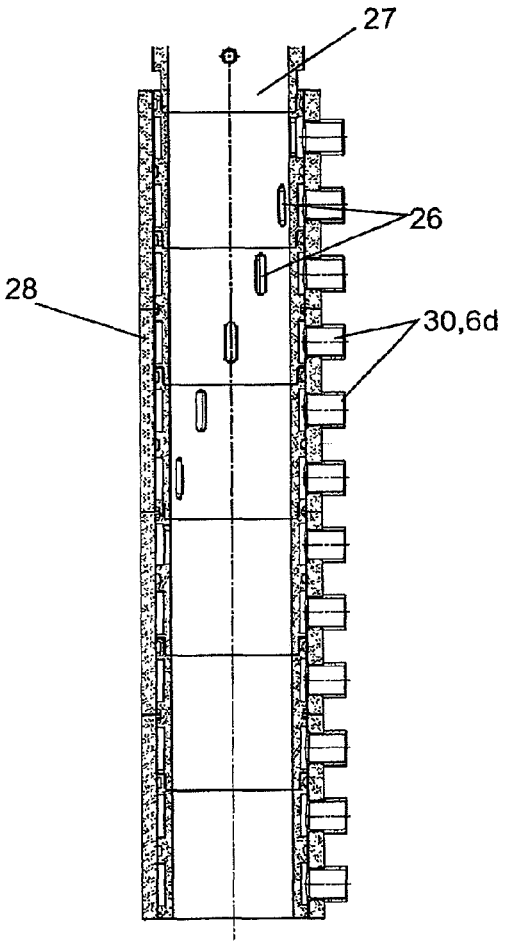
FIG. 16 shows a further partial sectional view of the rotating valve from FIG. 12 and FIG. 15.

A modification of a sealing strip of this type on the radial end regions of the division walls 25 is shown in FIG. 14. The seal 33 is thereby embodied in the manner of a sealing lip brushing over the inner wall, which sealing lip is inserted positively via a bead-like thickening 35 into a corresponding front groove of the division wall 25.

Figure 12:
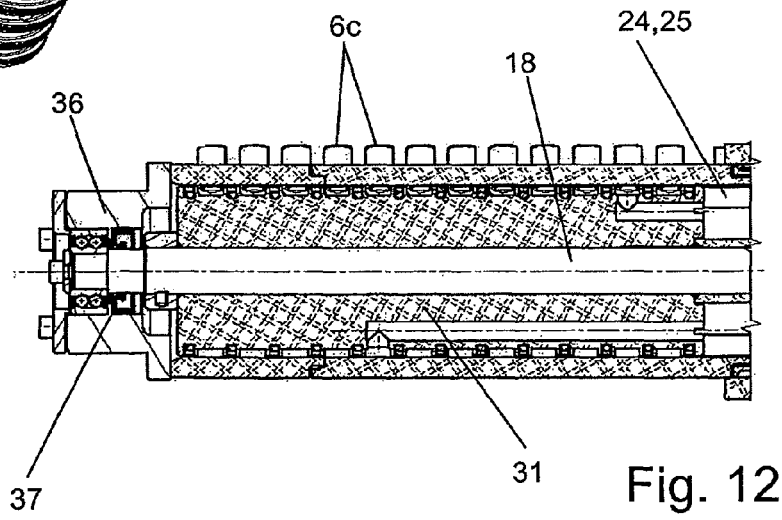
FIG. 12 shows a partial sectional view of a rotating valve with a switching device according to FIG. 11.

Another advantageous further development is shown in FIG. 12, in which the central shaft 18 of the switching device 24 is supported on at least one end of the rotating valve in a bearing bushing 36, which furthermore has a rotation seal 37. The rotation seal 37 additionally seals any possible leaks of fluid with respect to the outer area.

Figure 17:
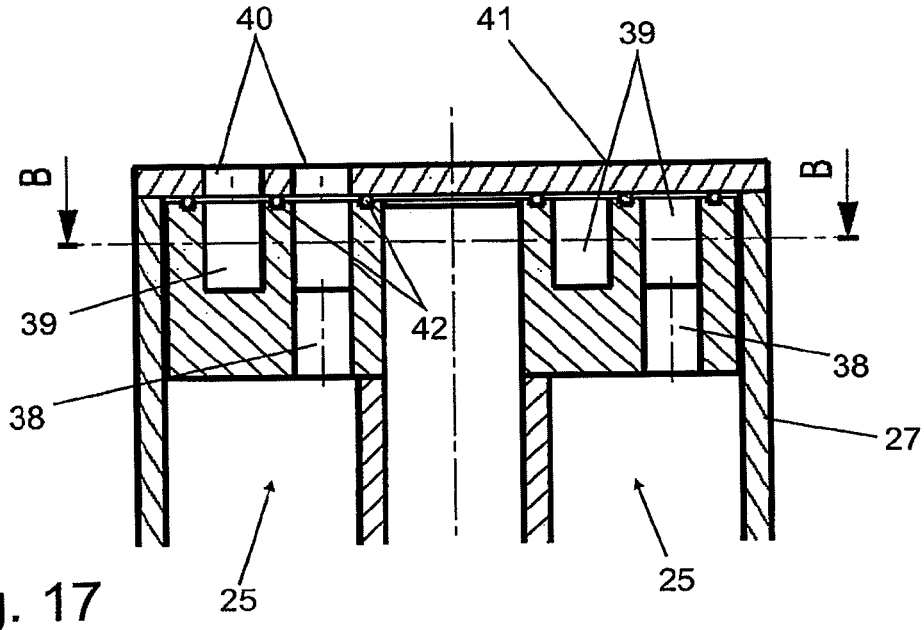
FIG. 17 shows a sectional view running parallel to a rotation axis of a further exemplary embodiment of a rotating valve.
Figure 18:
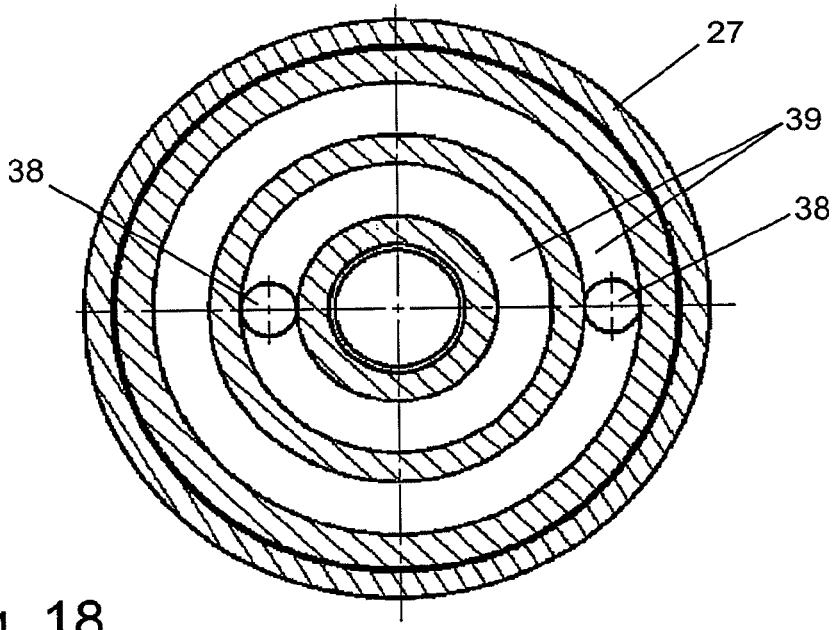
FIG. 18 shows a sectional view of the rotating valve from FIG. 17 along the line B-B.

Another exemplary embodiment of a rotating valve according to the invention is shown in FIGS. 17 and 18. Also with this valve the connection of the flow paths is carried out by means of radially directed division walls 25 and radially directed openings in the wall of an inner cylinder 27, which open into annular chambers of an outer cylinder (not shown).

In contrast to the embodiment, e.g., according to FIG. 11, in the embodiment according to FIG. 17 and FIG. 18, the inlet region of the fluid flows to the axial chambers divided by the division walls 25 is designed in a simple and compact manner. This is achieved in that each of the axially longitudinally directed chambers of the switching device separated by the division walls 25 is connected by respective one bore 38 to respectively one different concentric annular groove 39, wherein each of the annular grooves 39 is located in one plane with the other annular grooves 39, but has a different diameter. In the present exemplary embodiment according to FIG. 17 and FIG. 18, only two annular grooves 39 are shown for corresponding alternating switching of only two flow paths. More than two concentric annular grooves can also be provided, wherein in general a particularly high number of flow paths, such as, e.g., twelve flow paths as in the exemplary embodiments described above, are structurally increasingly complex. A rotating valve of this type, however, is very well suited for use, e.g., for the connection of the evaporator/condenser region of a heat pump explained above, since there usually only a few, e.g., two or four separate flow paths are switched.

The connection of annular grooves 39 of the switching device with outer inlets of the fluid flows is carried out via bores 40 in an inlet plate 41 connected in a stationary manner to the cylinder. Each of the bores 40 thereby opens into precisely one of the annular grooves 39, so that, according to the representation 17, each of the openings 40 of the inlet plate 41, regardless of the turn position of the switching device, is connected to precisely one of the axial chambers of the switching device formed by the axial division walls 25. To ensure the fluid-tight separation of the annular grooves, O-ring seals 42 are respectively provided between the inlet plate 41 and the walls of the annular grooves 39.

In the drawings FIG. 17 and FIG. 18 the outer cylinder with its annular chambers surrounding the inner cylinder 27 is not shown for reasons of clarity.

Figure 19:
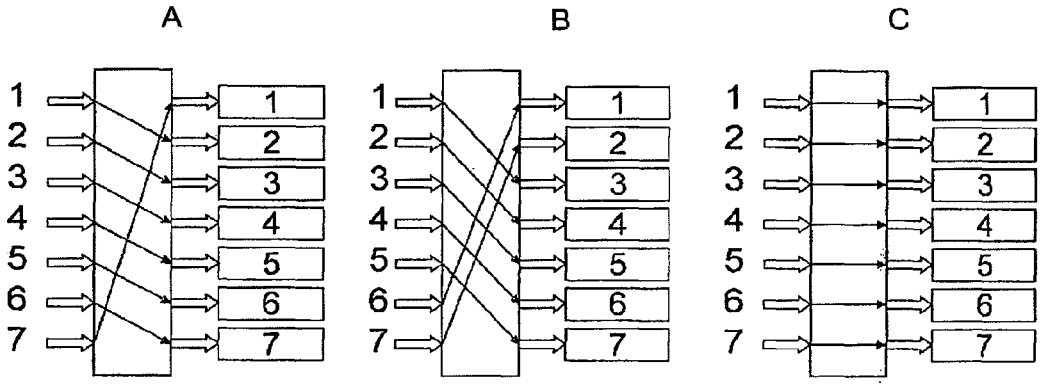
FIG. 19 shows a diagrammatic representation of the switching operations of a rotating valve according to the invention for the case of seven flow channels.
Figure 20:
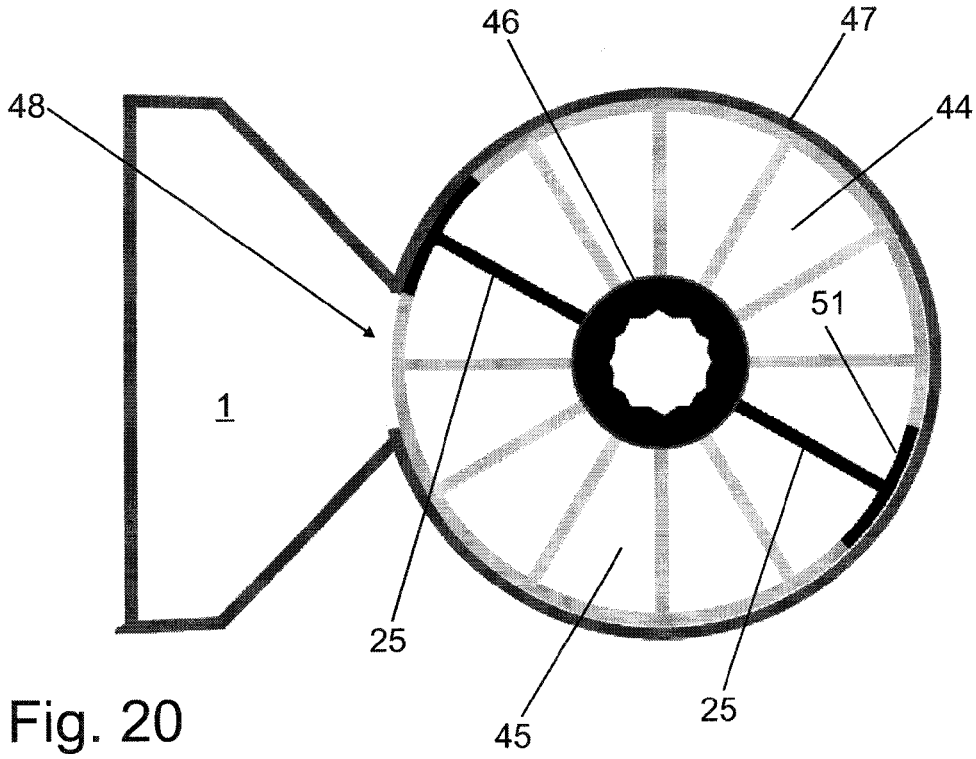
FIG. 20 shows a diagrammatic sectional view of a further exemplary embodiment of a rotating valve in a first valve position.
Figure 21:
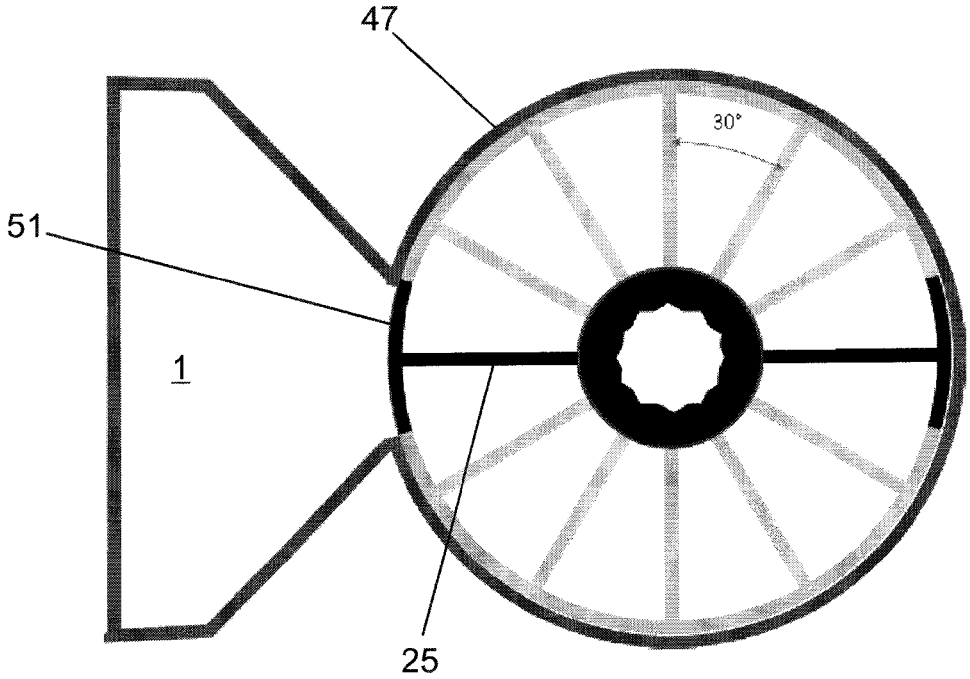
FIG. 21 shows the valve from FIG. 20 in a second valve position.
Figure 22:
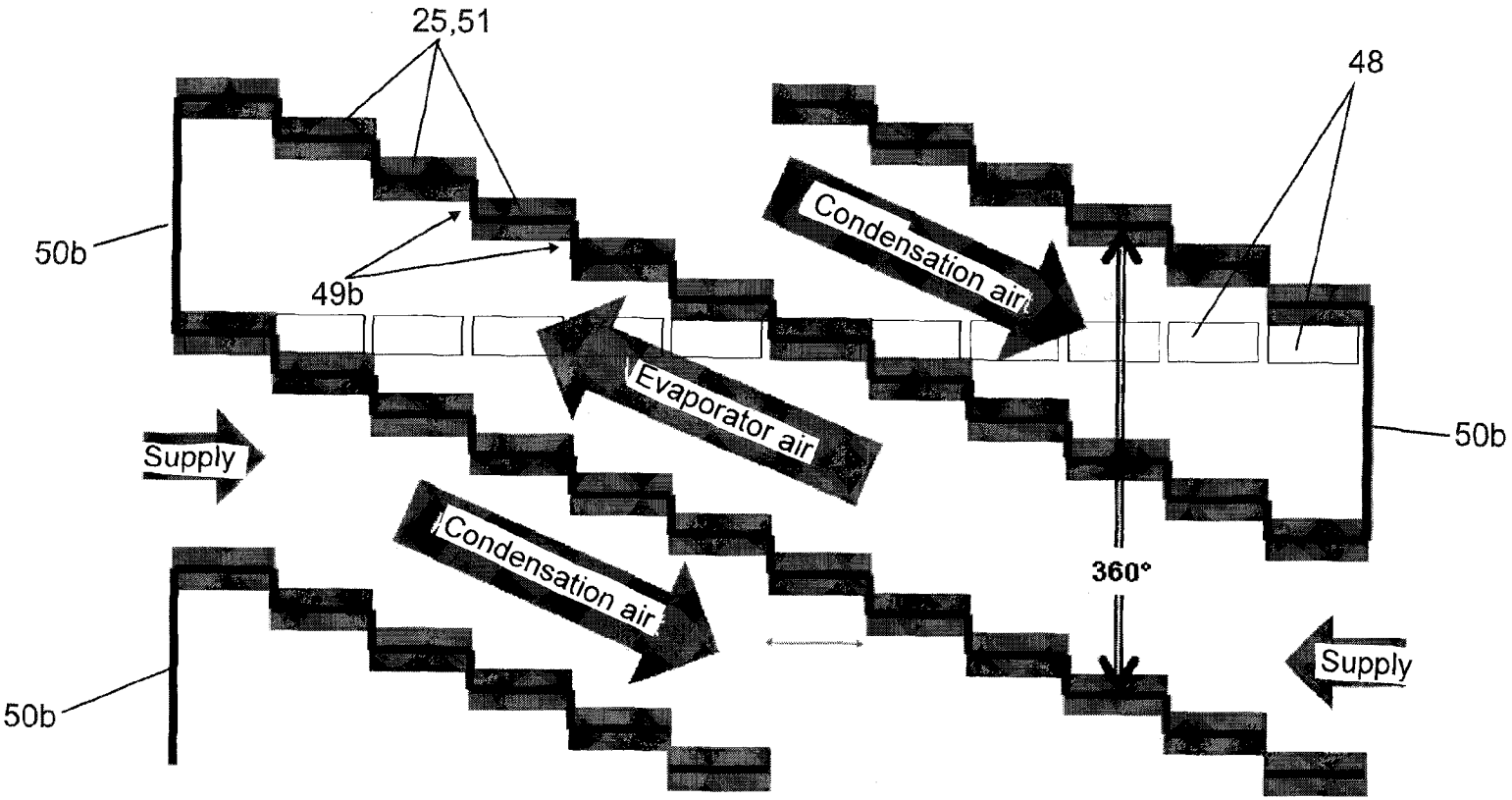
FIG. 22 shows a diagrammatic representation of an uncoiling of the rotating valve from FIG. 20, wherein the uncoiling takes place overall over 540°.

FIG. 19 shows diagrammatically the switching function of a rotating valve with seven alternately switched flow paths or fluid flows. Three switch positions A, B, C are shown, wherein position C is transferred into position A again after a further step. On the inlet side respectively the numbering of the fluid flows 1-7 is found, and on the outlet side the numbering of the hollow elements 1-7. After seven changes of the position or a full rotation of the rotating valve, the original connection is reached again.

The exemplary embodiment of a rotating valve 7 shown in FIG. 20 through FIG. 24 for combination with a heat pump according to the invention has only two chambers or flow channels 44, 45 and is particularly suitable to be combined with air as a second fluid for the exchange of heat with the second zones B of the hollow elements 1.

The rotating valve 7 of this exemplary embodiment has an only single-walled outer cylinder 47, which has radial openings 48 arranged in a straight row for connection to the hollow elements 1. A rotating switching device 24 accommodated in the cylinder 47 comprises a hub or shaft 46, from which two division walls 25 extend radially to the cylinder wall. In contrast to the exemplary embodiment according to FIG. 11, the division walls 25 are not straight in the axial direction nor, as known from the prior art WO 2007/068481 A1, embodied in a continuously coiled manner. Instead the division walls 25 are coiled in a stepwise manner, as shown in particular in the uncoiled representations according to FIG. 22.

Figure 23:
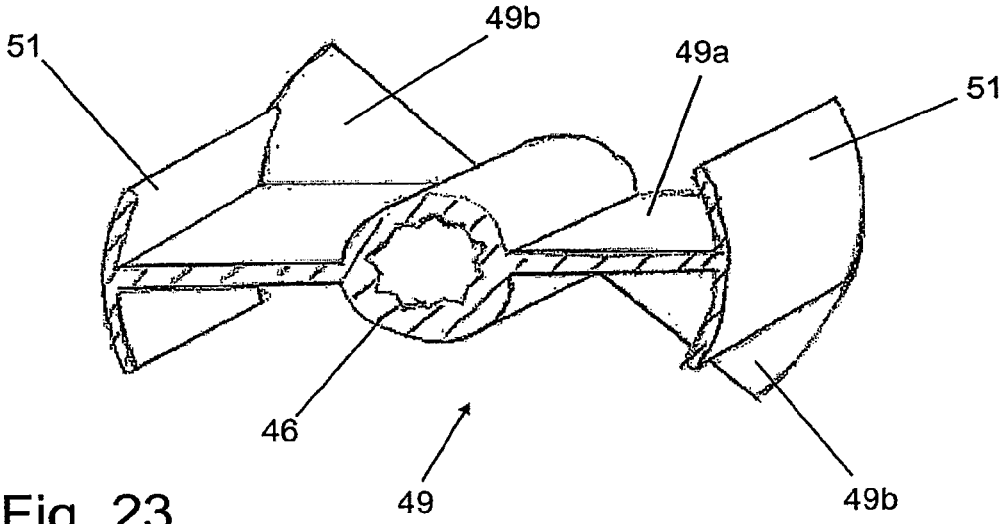
FIG. 23 shows a three-dimensional hand sketch of a center-portion switching device component of the rotating valve from FIG. 20.
Figure 24:
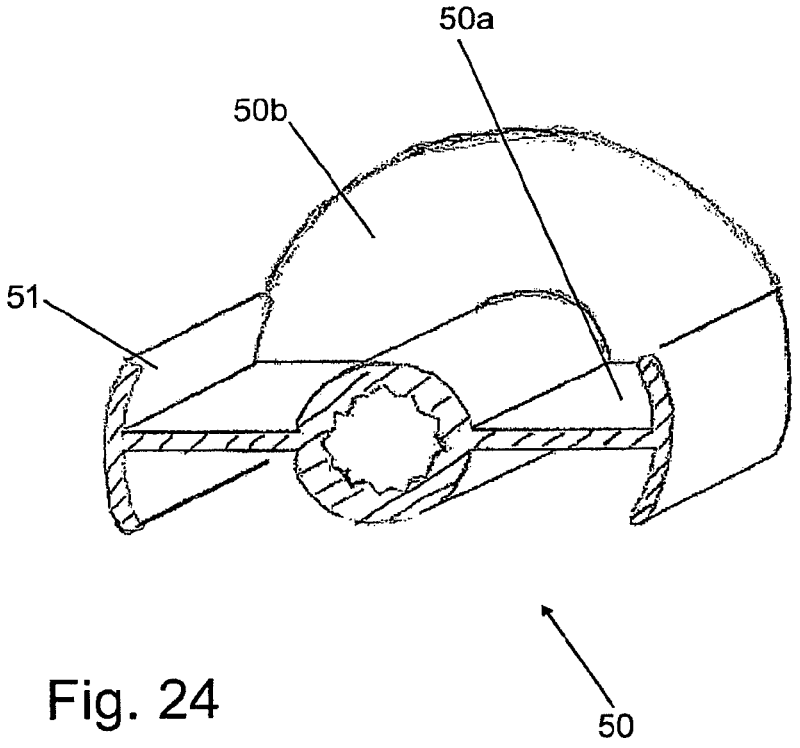
FIG. 24 shows a three-dimensional hand sketch from an end-side switching device component of the rotating valve from FIG. 20.

The stepwise coiling of the division walls 25 of the switching device 24 renders possible a simple structure of several switching device parts 49, 50 arranged axially one behind the other. FIG. 23 thereby shows a switching device 49, as is provided in the center region as a repetition of shared parts, which respectively are arranged offset to one another by a specific number of degrees. The switching device parts 49 have flat division wall sections 49*a* extending parallel to the rotation axis as well as cover sectors 49*b*, of in the current example an opening angle of 30°, extending perpendicular to the rotation axis and adjoining the division wall segments 49*a*, by means of which in total the stepwise coiled chambers or flow channels 44, 45 of the switching device 24 are formed.

The switching device parts 50 arranged on the end and forming closing pieces have an individual cover sector 50*b* with an opening angle of 180°, wherein these 180° cover sectors are arranged inversely to one another at the opposite ends of the switching device 24. An outer inlet and an outer outlet to the chambers 44, 45 are hereby formed in a simple manner, since the fluid (in this case, air) can be fed only at the one front face of the outer cylinder 47 and discharged at the opposite front face (see also the uncoiled representation according to FIG. 22). Depending on the current operating condition of the hollow elements of the second zone B, the fed air can thereby be referred to as evaporator air or as condensation air.

A further preferred detail of the rotating valve, which however is not necessary for the basic principle, lies in a cover tab 51 provided on the radial end side of the division wall sections 25, 49 and following the curvature of the cylinder 47. The opening angle of the cover tab 51 is approximately as large as the opening angle of the openings 48 of the cylinder wall, so that in one position (see representation in FIG. 21) respectively individual or, with a corresponding design, also several of the hollow elements 1 are closed with respect to the second zone B. In operation this represents an adiabatic intermediate step of the connections of the flow paths, whereby the effectiveness of the heat pump can be further improved.

In the present example, twelve hollow elements 1 are available, so that in total twelve switching device parts 49, 50, aligned rotated by respectively 30° to one another, are combined to form a switching device 24. However, deviating stages with a given number of hollow elements are also conceivable without the function of the rotating valve being substantially affected.

Figure 25:
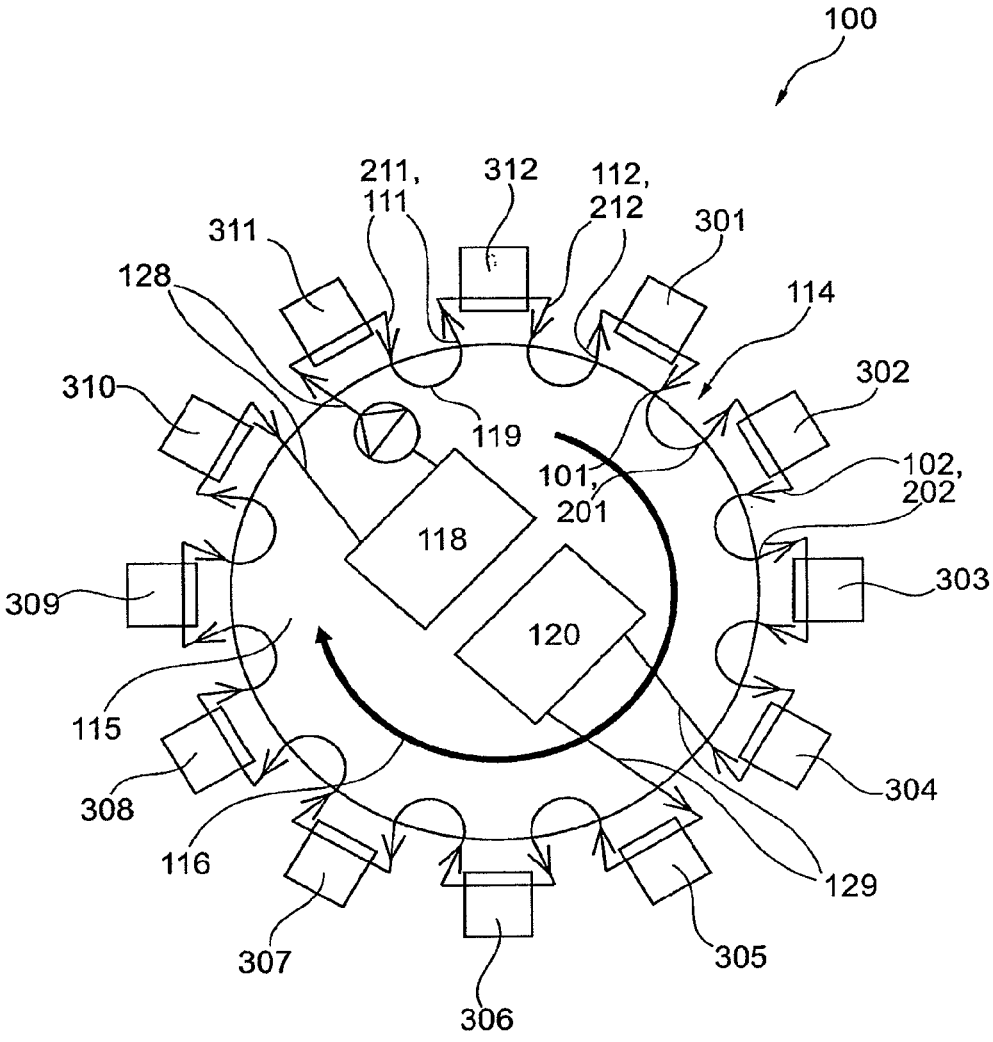
FIG. 25 shows a simplified representation of the switching function of a rotating valve according to a further exemplary embodiment.

FIG. 25 shows the switching function of a rotating valve 100 according to a further exemplary embodiment as a two-dimensional diagram. The rotating valve 100 comprises a plurality of inlets 101 to 112 and outlets 201 through 212, which can be individually assigned to the inlets 101 through 112 via connecting lines 126 or 128 and 129. The inlets and outlets are connected, e.g., to thermally active modules 301 through 312. The rotating valve 100 comprises a switching device 114, which in turn comprises a rotating body 115, which is rotatable, as indicated by an arrow 116. In the rotating body 115 a first heat exchanger is shown in the form of a cooler 118, to which a pump 119 is connected downstream. A second heat exchanger is embodied as a heater 120.

The rotating valve 100 shown in FIG. 25 is used to control the through flow of twelve thermally active modules, as described above based on the exemplary embodiments of FIGS. 1 through 24, with a heat transfer fluid. With the rotating valve 100 shown in FIG. 25, the twelve thermally active modules 301 through 312 can be flowed through in series by a heat transfer fluid. The heat source, in particular the heater 120, and the heat sink, in particular the recooler 118 are switched between respectively two of the modules. The rotating valve 100 has the function of shifting the location of the interconnection of the heater 120 and the recooler 118 in a stepwise manner without this having to be rotated too, as would be necessary with a direct conversion of the diagrammatic switching. Deviating from the representation of FIG. 25, the cooler 118, the pump 119 and the heater 120 are therefore arranged in a stationary manner outside the rotating valve 100 in the following figures of an exemplary structural conversion.

Figure 26:
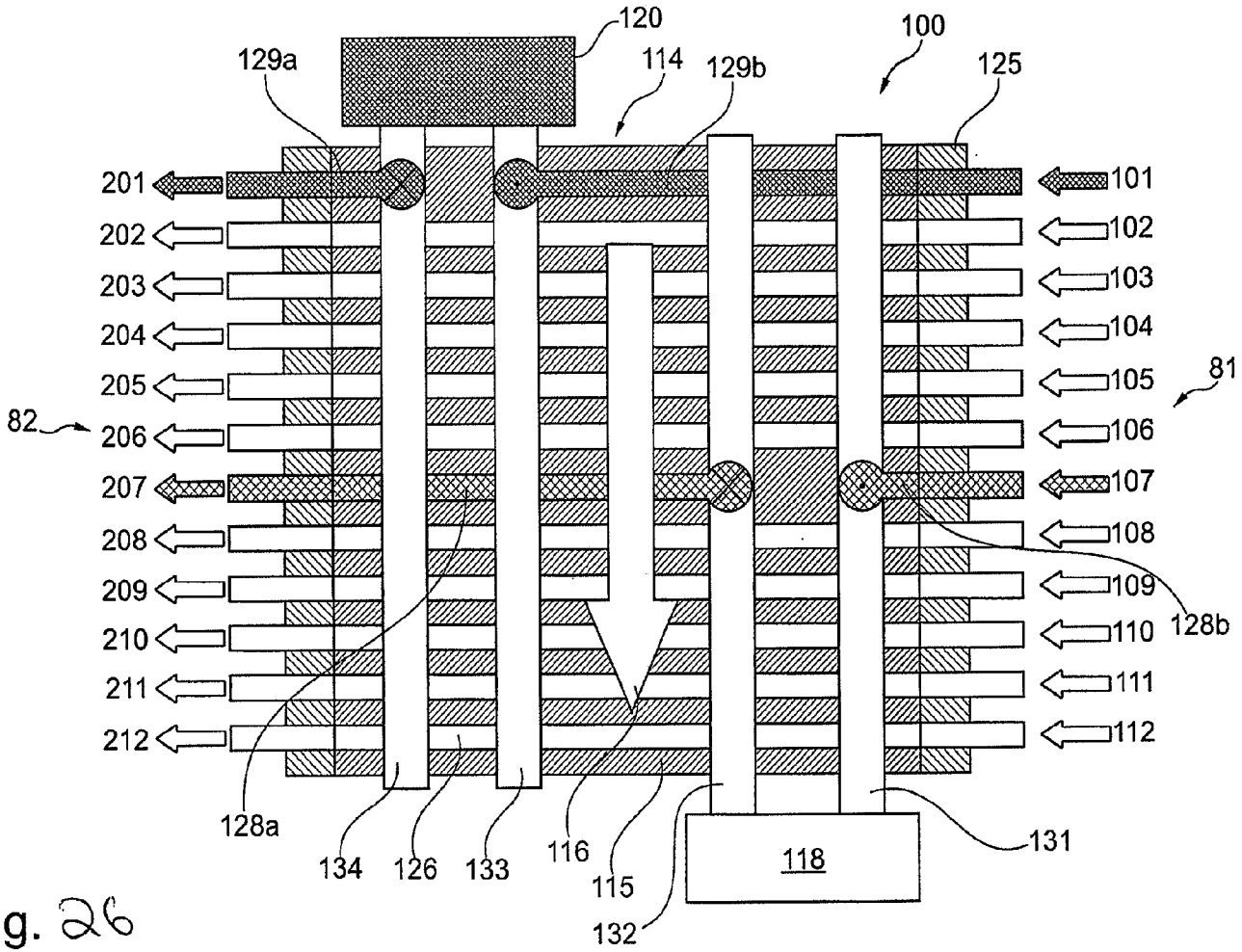
FIG. 26 shows a view of the rotating valve from FIG. 25 in a first position.
Figure 27:
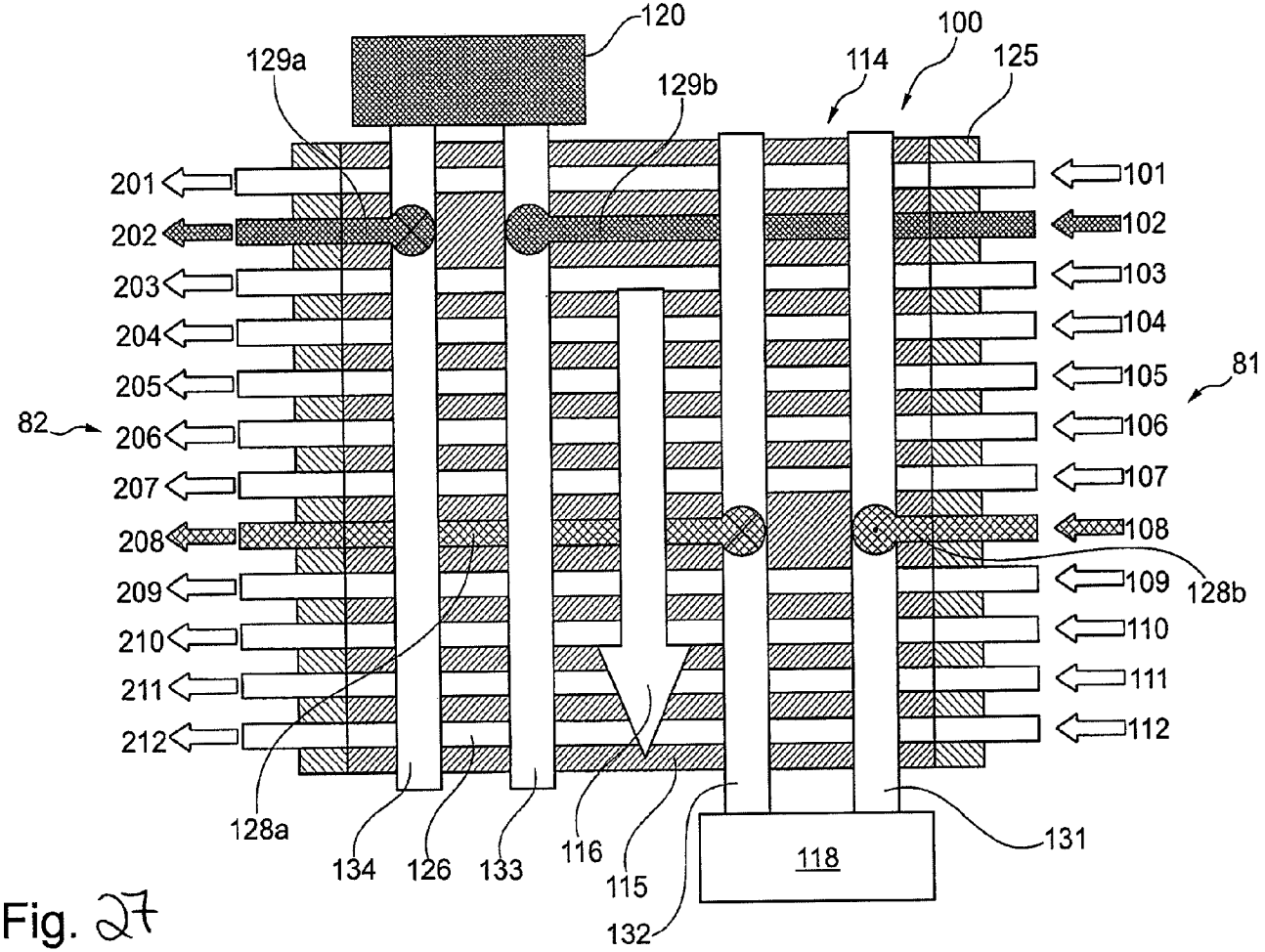
FIG. 27 shows the rotating valve from FIG. 26 in a second position.

In FIGS. 26 and 27 the rotating valve 100 from FIG. 25 is initially shown in a diagrammatic developed view. The rotating valve 100 comprises twelve inlets 101 through 112, which can also be referred to as entrances and are combined to form one inlet region 81. Analogously, the rotating valve 100 comprises twelve outlets 201 through 212, which can also be referred to as exits, and are combined to form an outlet region 82. The inlets 101 through 112 can be connected with the aid of the switching device 114, which comprises the rotating body 115, in a different manner to the outlets 201 through 212 when the rotating body 115 rotates in the direction of the arrow 116. In FIGS. 26 and 27 the cooler 118 and the heater 120 are arranged outside a housing 125.

An opening in a front face of the housing 125 is assigned to each inlet 101 through 112 and each outlet 201 through 212, which housing essentially has the form of a hollow circular cylinder. The inlets and outlets open in the front faces of the housing 125. An opening in the rotating body 115 can be assigned to each opening in the housing 125. Through these positions each of the inlets 101 through 112 can be connected in a defined manner to the associated outlet 201 through 212. With the exemplary embodiment shown in FIG. 26, the inlets 102 through 106 and 108 through 112 are connected via respectively one through channel 126 to the associated outlets 202 through 206 and 208 through 212. The through channels 126 extend in a straight line through the rotating body 115.

The inlets 101 and 107 are connected via interrupted connecting channels 128, 129 respectively to the associated outlet 201, 207. The connecting channels 128, 129 are divided by means of division walls or the like into partial channels 128*a*, 128*b* or 129*a*, 129*b* such that they force a flow deflection via the cooler 118 or the heater 120. To this end, four annular chambers 131 through 134 are provided inside the housing 125, which annular chambers are shown as straight channels in the developed view of FIGS. 26 and 27. The inlet 101 is connected via the interrupted connecting channel 129 to the annular chamber 133, which in turn is connected to the heater 120.

The heater 120 is connected via the annular chamber 134 to the outlet 201. Analogously, the inlet 107 is connected via the annular chamber 131 to the cooler 118, which in turn is connected via the annular chamber 132 and the interrupted connecting channel 128 to the outlet 127. Through the rotation of the rotating body 115 in the direction of the arrow 116 the through channels 126 and the interrupted connecting channels 128, 129 are assigned different inlets and outlets. This shift is carried out preferably in a stepwise manner such that the rotating body 115 always comes to a stop when the openings of the channels 126, 128, 129 provided in the rotating body 115, overlap with the corresponding openings in the housing 125.

In FIG. 27 the rotating body 114 is shown rotated by one step compared to the representation of FIG. 26. In FIG. 27 the inlet 102 is connected via the heater 120 to the associated outlet 202. Analogously, the inlet 108 is connected via the cooler 118 to the associated outlet 208. The other inlets 101, 103 through 107, 109 through 112 are directly connected via the though channels 126 to the associated outlets 201, 203 through 207, 209 through 212.

Figure 28:
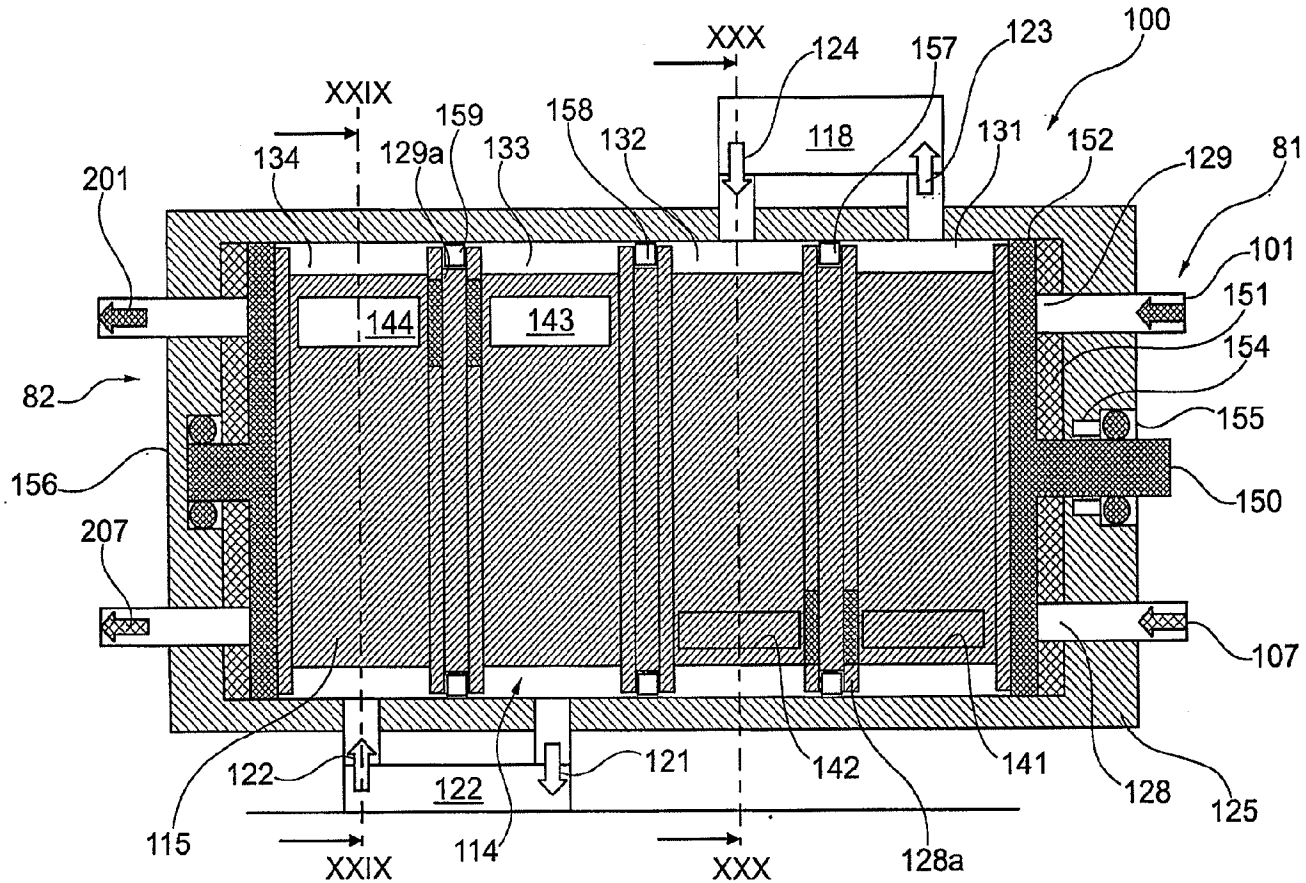
FIG. 28 is a detailed representation of the rotating valve from FIGS. 26 and 27 in a longitudinal section.
Figure 30:
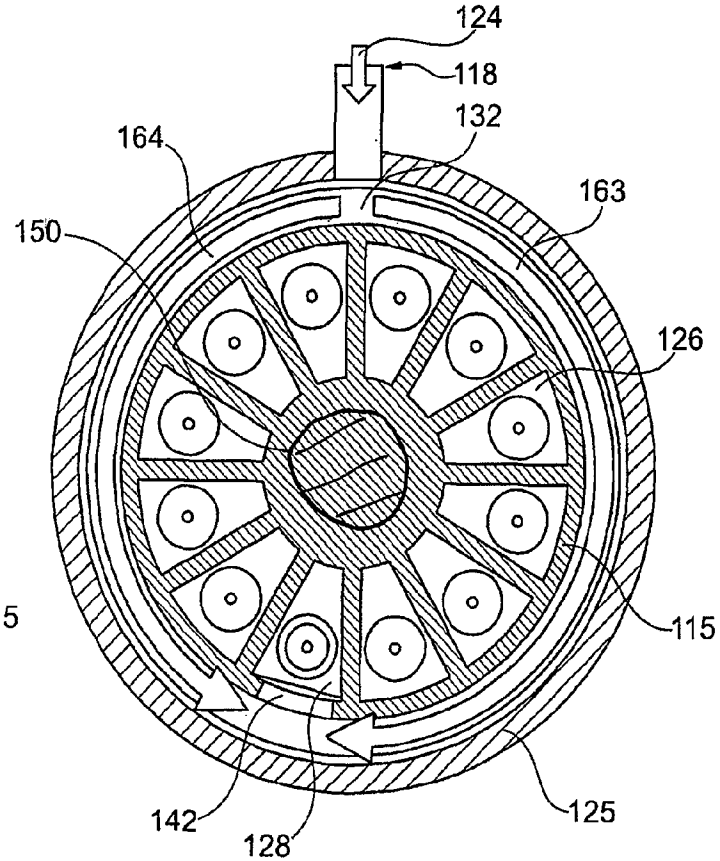
FIG. 30 shows a view of a section along the line XXX-XXX in FIG. 28.
Figure 29:
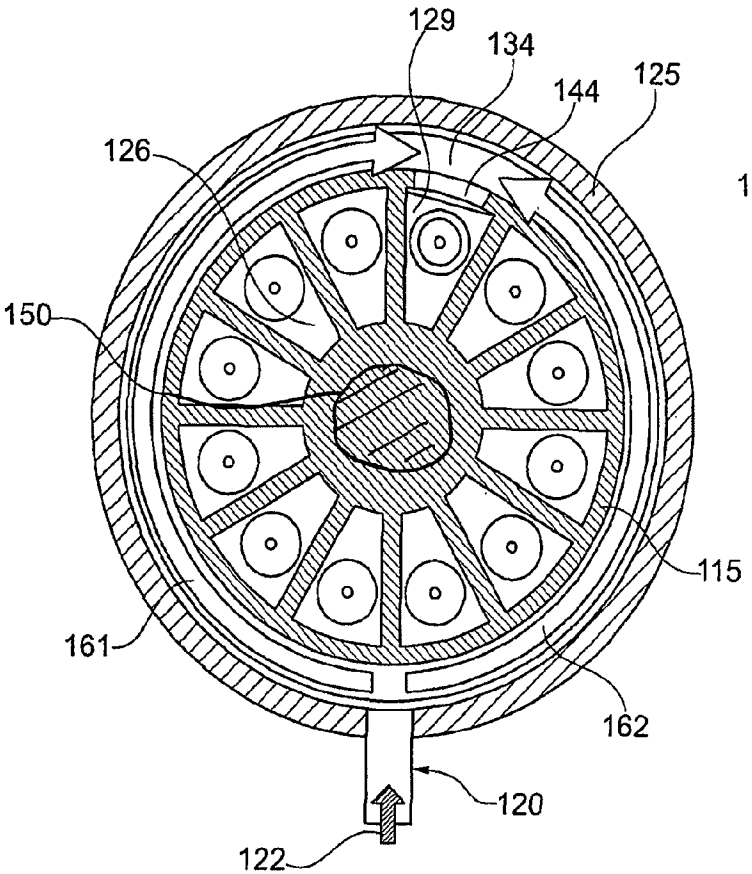
FIG. 29 shows a view of a section along the line XXIX-XXIX in FIG. 28

In FIGS. 28 through 30 the rotating valve 100 shown in a simplified manner in FIGS. 26 and 27 is shown in somewhat more detail. In the cylindrical housing 125 shown in longitudinal section the rotating body 115 is driven in a rotatable manner with the aid of a supported drive shaft 150 sealed to the surroundings. For the axial support of the rotating body 115, on each front face of the housing 125 respectively two ceramic sealing plates 151, 152 are provided. The ceramic sealing plate 151 is fixedly assigned to the housing 125. The ceramic sealing plate 152 is assigned to the rotating body 115 and rotates therewith relative to the ceramic sealing plate 151 and the housing 125. The two pairs of plates can be prestressed elastically with respect to one another via a spring device (not shown).

Four annular chambers or annular spaces 131 through 134 are respectively connected via a radial opening 141 through 144 to the associated connecting channel 128, 129. The radial openings 141 through 144 represent a radial through window, which creates a fluid connection between the annular chambers 131-134 and the axial connecting channels 128, 129 arranged radially inside, which in contrast to all of the other connecting channels 126 are subdivided by at least respectively one division wall 128*c* or 129*c* into two partial channels 128*a* and 128*b* or 129*a* and 129*b*. The positions between the partial channels 128*a*, 128*b* or 129*a*, 129*b* and the annular chambers 131 through 134 are preferably selected such that each two adjacent annular chambers 131, 132 and 133, 134 are connected to corresponding, i.e., aligned with one another, inlets 101; 107 and outlets 201; 207. Regardless of the position or rotation of the rotating body 115, one fluid path is thereby always guided through the heater 120 and another of the total of twelve available fluid paths through the cooler or recooler 118.

In FIG. 28 the fluid from the inlet 101 reaches the heater 120 via the radial opening 143 and the annular chamber 133, as indicated by an arrow 121. It is indicated by a further arrow 122 that the fluid from the heater 120 reaches the outlet 201 via the annular chamber 134 and the radial opening 144. Analogously, the fluid reaches the cooler 118 from the inlet 107 via the radial opening 141 and the annular chamber 131, as indicated by an arrow 123. It is indicated by a further arrow 124 that the fluid from the cooler 118 reaches the outlet 207 via the annular chamber 132 and the radial opening 142.

It can be seen in FIG. 28 that the rotor axis with the bearings 155, 156 is supported in the cylindrical housing and the entire inner volume is sealed from the surroundings by a sealing element 154. Furthermore, apart from the two preferably ceramic area seal pairs 151, 52, only three further sealing elements 157, 158, 159 are necessary in order to seal the four annular chambers 131 through 134 in the axial direction with respect to one another.

In FIGS. 29 and 30 two sections through the rotating valve 100 from FIG. 28 are shown. In FIG. 29 it is indicated by arrows 161 and 162 how the fluid reaches the radial opening 144 from the heater 120. In FIG. 30 it is indicated by further arrows 163, 164 how the fluid reaches the radial opening 142 from the cooler 118. Furthermore, the sections show the rotating body 115 divided into 12 axial chambers, which is positively stacked preferably of plastic injection molded elements on a joint shaft 150. The reference numbers 128 and 129 designate the through channels which are divided by means of division walls 128*c* or 129*c* into respectively two partial channels 128*a*, 128*b* or 129*a*, 129*b*.

Figure 32:
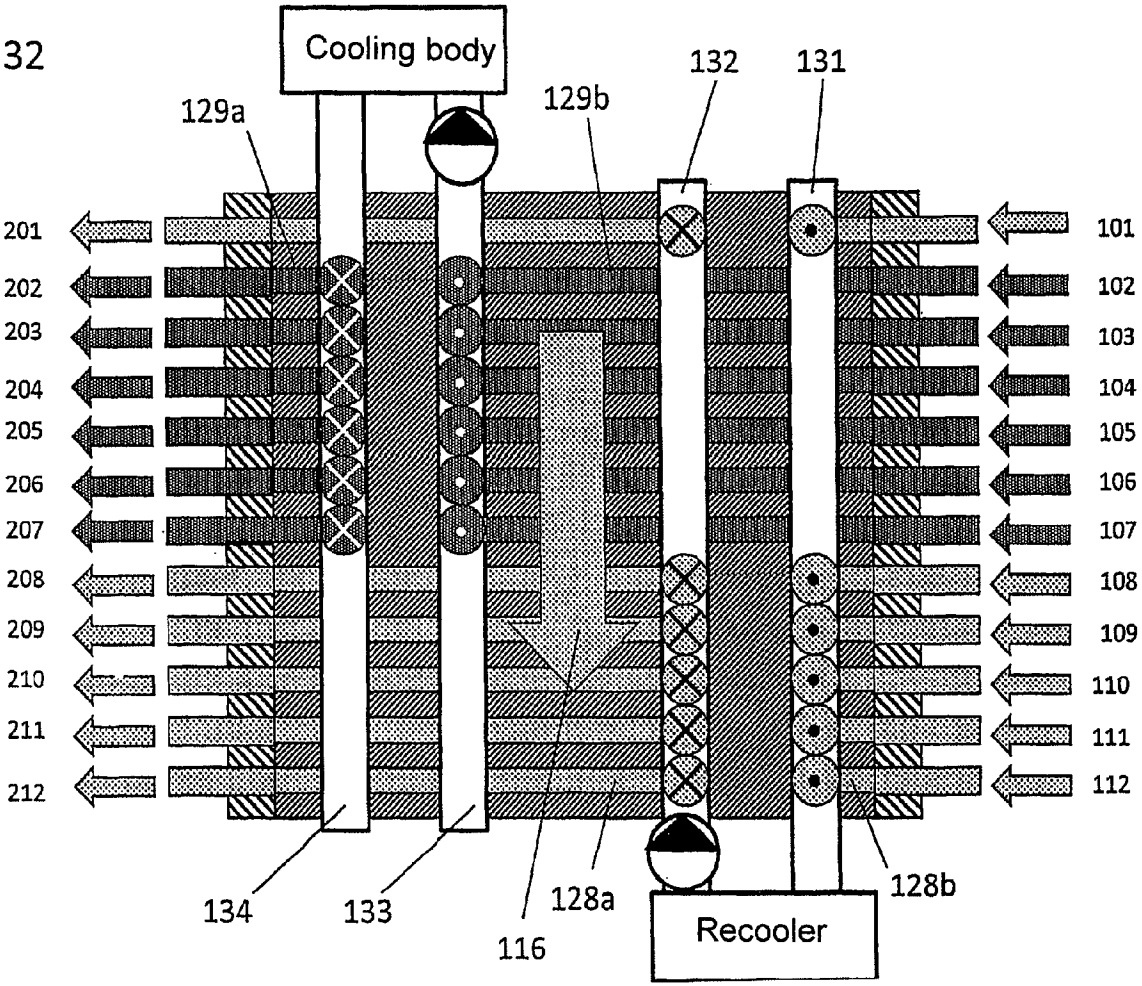
FIG. 32 shows the rotating valve from FIG. 31 in a second position.

The use of a slightly modified valve is advantageous to control the fluid circulations of the evaporation/condensation zones, the developed view of which valve is shown in FIGS. 31 and 32 in two positions.

As shown in FIG. 31, the rotating body 115 has only interrupted through channels in the manner of reference numbers 128 and 129, which are respectively divided again by division walls 128*c* and 129*c* into partial channels 128*a*, 128*b* or 129*a*, 129*b* and have radial through windows to the annular chambers 131 through 134, which in turn are connected in pairs to two heat transferors, which are labeled "cooling body" and "recooler." In the embodiment shown there are therefore no longer any purely through channels of the category according to reference number 126.

FIG. 32 shows the rotating valve in the subsequent position.

This modified embodiment renders possible a position, dependent on the switching position of the rotating valve, of thermally active modules 301 through 312 to at least two separate fluid circulations driven by their own conveyor devices inside which the assigned modules are flowed through in parallel.

Through the respective parallel guidance of two groups of through channels 128 and 129 in the rotating body 115, several radial through windows are required, which produce a flow connection in respectively one common annular chamber of the total of four annular chambers required. Preferably, in the rotating body the division walls inside a group of through channels can be omitted, whereby per annular chamber only one large radial through window is then necessary, which is not shown in more detail here in terms of the image.

The two embodiments according to FIG. 26, 27 or 31, 32 represent only two examples of the division of the through channels according to the categories 126, 128 and 129. Further divisions of the through channels among these categories are naturally possible and also useful for special applications.

The rotating valve 100 has, among other things, the following advantages: high integration of switching function replaces two conventional rotating valves; reduced expenditure for drive and control; compact, material-saving design; simple, cost-effective producibility, for example of plastic injection molded parts; easily realized, wear-resistant area seal via ceramic disks or ceramic plates 151, 152; short flow paths with low heat exchange between the individual flow paths; low friction and necessary input torque; low bypass losses.

Naturally, the special features of the individual exemplary embodiments can be usefully combined with one another according to requirements.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A rotating valve comprising:

an inlet region having a plurality of stationary separate inlets for several flows of a fluid;

an outlet region having a plurality of stationary separate outlets for the flows of the fluid, a number of outlets corresponding to a number of inlets; and a switching region with a switching device that is rotatable about an axis, the switching region being arranged between the inlet region and the outlet region, wherein in a first position of the switching device, the plurality of inlets are connectable to the plurality of outlets in a first position, wherein in a second position of the switching device, the plurality of inlets are connectable to the plurality of outlets in a second position, wherein the switching device comprises a plurality of openings that are movable with the switching device and are configured to be flowed through by the fluid flows axially in a direction of the rotation axis, which openings alternately overlap a plurality of stationary, axially directed openings in the direction of the rotation of the switching device, and wherein different positions of the inlets to the outlets are carried out through an alternating overlapping of the axially directed openings.

2. The rotating valve according to claim 1, wherein the switching device is configured as an axial longitudinal body, which is accommodated in a stationary, essentially cylindrical wall, and wherein either the inlets or the outlets are connectable via radially directed openings of the wall.

3. The rotating valve according to claim 2, wherein the longitudinal body has a number of axially directed separate channels corresponding to the plurality of inlets for the fluid flows, and wherein each channel has a radial opening to connect with one of the openings of the wall.

4. The rotating valve according to claim 2, wherein at least one of the longitudinal body or the wall has full perimeter annular sealing members, which interact in a sealing manner with the respective other of the two, longitudinal body or the wall so that the openings of the wall are separated from one another.

5. The rotating valve according to claim 4, wherein the sealing members comprise a seal, which is arranged on radial projections of at least one of the longitudinal body or the wall.

6. The rotating valve according to claim 4, wherein the sealing members are configured in one piece with the longitudinal body and/or the wall.

7. The rotating valve according to claim 2, wherein the longitudinal body is formed as a one-piece component.

8. The rotating valve according to claim 2, wherein the longitudinal body comprises a plurality of longitudinal body elements stacked in the axial direction.

9. The rotating valve according to claim 8, wherein at least some of the longitudinal body elements are configured as shared components.

10. The rotating valve according to claim 1, wherein the switching device is penetrated by a rotatable shaft in the axial direction, wherein the shaft is configured as a tie rod to hold several components of the switching device, the components being arranged axially one behind the other.

11. The rotating valve according to claim 1, wherein the switching device is supported in a rotatable manner on an end side via a bearing member, and wherein the bearing member has a rotation seal for sealing the fluid.

12. The rotating valve according to claim 1, wherein the number of inlets and outlets is at least four, preferably at least eight.

13. The rotating valve according to claim 1, wherein at least one inlet of the plurality of inlets in a first heat exchanger position is connectable to an associated outlet via a first heat exchanger or a heater, wherein at least one further inlet of the plurality of inlets in a second heat exchanger position is connectable to an associated outlet via a second heat exchanger or a cooler, and wherein the other inlets of the plurality of inlets in a through position are connectable to associated outlets via one respective through channel.

14. The rotating valve according to claim 13, wherein the switching device has a rotating body with a plurality of through channels, which connect the other inlets in the through position to the associated outlets.

15. The rotating valve according to claim 14, wherein the through channels extend in an axial direction through the rotating body.

16. The rotating valve according to claim 14, wherein several, in particular four, annular chambers extend around the rotating body, which, depending on a position of the rotating body, are connectable to respectively one of the inlets and/or one of the outlets.

17. The rotating valve according to claim 16, wherein respectively two of the annular chambers are connectable to one another in pairs via one of the heat exchangers.

18. The rotating valve according to claim 17, wherein the annular chambers are connectable via radial openings and a connecting channel interrupted in the axial direction in pairs to one of the inlets or one of the outlets.

19. The rotating valve according to claim 17, wherein the rotating body is configured such that it is rotatable in a stationary housing such that the inlets are connected successively via the different through channels or the annular chambers and one of the heat exchangers to the associated outlets.

20. The rotating valve according to claim 19, wherein the housing has essentially the form of a hollow circular cylinder.

21. The rotating valve according to claim 14, wherein the rotating body comprises a plurality of longitudinal body elements stacked in the axial direction.

22. The rotating valve according to claim 21, wherein at least some of the longitudinal body elements are embodied as shared parts.

23. The heat pump according to claim 13, wherein the second fluid is air.

24. A rotating valve comprising:

an inlet region with a plurality of stationary separate inlets for several flows of a fluid;

an outlet region with a plurality of stationary separate outlets for the flows of the fluid, a number of the outlets corresponding to a number of inlets;

a switching region having a switching device rotatable about an axis is arranged between the inlet region and the outlet region, wherein in a first position of the switching device, the plurality of inlets are connectable to the plurality of outlets in a first position, and wherein in a second position of the switching device, the plurality of inlets are connectable to the plurality of outlets in a second position, wherein the switching device is configured as a longitudinal body with axially extending division walls forming a plurality of parallel channels, wherein on radially end-side regions of the division walls, a separate seal extending axially is arranged, through which the division walls are supported in a sealing manner against a cylindrical wall comprising the switching device.

25. The rotating valve according to claim 24, wherein the seal has a U-shaped, H-shaped or X-shaped cross section.

26. The rotating valve according to claim 24, wherein the seal has an elastic sealing tab, which bears against the cylindrical wall.

27. The rotating valve according to claim 24, wherein the seal is inserted into a groove of the division wall.

28. The rotating valve according to claim 24, wherein the channels for changing the position alternately overlap with radially directed openings offset in the circumferential direction of the inner wall of a stationary inner cylinder, and wherein annular chambers separate from one another and arranged one behind the other in the axial direction are provided between the inner cylinder and an outer housing surrounding it.

29. The rotating valve according to claim 24, wherein the channels to change the position alternately overlap with radially directed openings offset in the circumferential direction of the inner wall of a stationary inner cylinder, and wherein annular chambers separate from one another and arranged one behind the other in the axial direction are arranged between the inner cylinder and an outer housing surrounding it.

30. A rotating valve comprising:

an inlet region with a plurality of stationary separate inlets for several flows of a fluid;

an outlet region with a plurality of stationary separate outlets for the flows of the fluid, a number of outlets corresponding to a number of inlets; and a switching region having a switching device that is rotatable about an axis is arranged between the inlet region and the outlet region, wherein, in a first position of the switching device, the plurality of inlets are connectable to the plurality of outlets in a first position, wherein, in a second position of the switching device, the plurality of inlets are connectable to the plurality of outlets in a second position, wherein the switching device is configured as a longitudinal body with axially extending division walls forming a plurality of parallel channels, wherein each of the channels is connectable to one of several annular grooves of the switching device concentric with respect to the rotation axis, and wherein each of the annular grooves overlaps with a respectively stationary opening of the inlets or outlets.

31. A heat pump comprising:

a plurality of hollow elements, wherein at least one first zone and at least one second zone for displacement of a working fluid are arranged in each of the hollow element based on thermodynamic state variables, wherein each of the hollow elements with its first zone is thermally connectable to a linear first flow channel of the hollow element that is configured to be flowed through by a first fluid, and with its second zone is thermally connectable to a linear second flow channel of the hollow element that is configured to be flowed through by a second fluid so that thermal energy is exchanged between one of the fluids and one of the zones; and a valve arrangement, wherein the flow channels of one of the zones are connectable sequentially with one another via the valve arrangement and a sequence of the connection changes via the valve arrangement in the course of an operation of the heat pump, and wherein the valve arrangement comprises a rotating valve.

32. The heat pump according to claim 31, wherein the hollow elements are adsorber elements, wherein the adsorber elements in the region of the first zone have an adsorption/desorption range for the working fluid and in the region of the second zone have a condensation/evaporation zone for the working fluid.

33. The heat pump according to claim 31, wherein at least one of the flow channels has end-side connecting pieces, wherein the fluid in the region of the connecting pieces is distributed among a plurality of flow paths.

34. The heat pump according to claim 31, wherein one or more flow paths for the fluid is embodied by a gap between sub-elements arranged on top of one another.

35. The heat pump according to claim 31, wherein the through flow paths are provided with surface-enlarging structures or ribs.

36. The heat pump according to claim 31, wherein the hollow elements are embodied respectively as separate modules, which are not in thermal contact with one another.

37. The heat pump according to claim 35, wherein between adjacent hollow elements a layer of a thermally insulating, in particular elastic material is arranged.

38. The heat pump according to claim 31, wherein the valve arrangement is embodied as a connection of a number of discrete multiway valves that are actuatable electromagnetically.

39. The heat pump according to claim 31, wherein the valve arrangement comprises at least one, in particular at least two rotating valves.

40. The heat pump according to claim 38, wherein at least some of the flow channels of the hollow elements are connectable via elastically deformable connecting pieces to the inlets and/or outlets of the rotating valve.

41. The heat pump according to claim 31, wherein the rotating valve of the second fluid has a switching device with a division wall coiled in a stepwise manner, and wherein a number of steps of the coiling corresponds to a number of hollow elements.

42. The heat pump according to claim 41, wherein the switching device is embodied from a plurality of switching device elements, in particular embodied as shared parts and arranged axially one behind the other.

43. The heat pump according to claim 31, wherein the second fluid is distributed via a rotating valve with two flow channels via the two zones of the hollow elements.

44. A heat pump comprising:

a plurality of hollow elements, wherein at least one first zone and at least one second zone for displacement of a working fluid are arranged in each of the hollow element based on thermodynamic state variables, wherein each of the hollow elements with its first zone is thermally connectable to a first flow channel of the hollow element that is configured to be flowed through by a first fluid, and with its second zone is thermally connectable to a second flow channel of the hollow element that is configured to be flowed through by a second fluid so that thermal energy is exchanged between one of the fluids and one of the zones; and a valve arrangement, wherein the flow channels of one of the zones are connectable sequentially with one another via the valve arrangement and a sequence of the connection changes via the valve arrangement in the course of an operation of the heat pump, and wherein the valve arrangement comprises a rotating valve, the rotating valve comprising:

an inlet region having a plurality of stationary separate inlets for several flows of a fluid;

an outlet region having a plurality of stationary separate outlets for the flows of the fluid, a number of outlets corresponding to a number of inlets; and a switching region with a switching device that is rotatable about an axis, the switching region being arranged between the inlet region and the outlet region, wherein in a first position of the switching device, the plurality of inlets are connectable to the plurality of outlets in a first position, wherein in a second position of the switching device, the plurality of inlets are connectable to the plurality of outlets in a second position, wherein the switching device comprises a plurality of openings that are movable with the switching device and are configured to be flowed through by the fluid flows axially in a direction of the rotation axis, which openings alternately overlap a plurality of stationary, axially directed openings in the direction of the rotation of the switching device, and wherein different positions of the inlets to the outlets are carried out through an alternating overlapping of the axially directed openings.

* * * * *